US005971060A

United States Patent [19]

Ikeda et al.

[11] Patent Number: 5,971,060

[45] Date of Patent: Oct. 26, 1999

[54] SLAB CONTINUOUS CASTING MACHINE HAVING IMMERSING NOZZLE REPLACING APPARATUS AND METHOD OF REPLACING IMMERSING NOZZLE

[75] Inventors: Masahiro Ikeda, Niihama; Moriki Hashio, Narashino; Masakazu Koide, Amagasaki, all of Japan

[73] Assignee: Sumitomo Heavy Industries, Ltd., Tokyo, Japan

[21] Appl. No.: 09/008,630

[22] Filed: Jan. 16, 1998

[30] Foreign Application Priority Data

Jan. 17, 1997 [JP] Japan ..... 9-006251
Jul. 16, 1997 [JP] Japan ..... 9-207149

[51] Int. Cl.[6] ..... B22D 11/10

[52] U.S. Cl. ..... 164/488; 164/437; 222/606

[58] Field of Search ..... 164/437, 488; 222/606, 607

[56] References Cited

U.S. PATENT DOCUMENTS 4,091,861 5/1978 Thalmann et al. ..... 164/437
4,669,528 6/1987 Szadkowski .
5,180,536 1/1993 Bruckner et al. .
5,351,865 10/1994 Szadkowski et al. .

FOREIGN PATENT DOCUMENTS 0484562 5/1992 European Pat. Off. .
0718058 6/1996 European Pat. Off. .
250671 10/1987 Germany ..... 164/437
4-251641 9/1992 Japan .

OTHER PUBLICATIONS

"Shinagawa Technical Report" No. 38 (1995), Shinagawa Refractories Co., Ltd.

*Primary Examiner*—Kuang Y. Lin
*Attorney, Agent, or Firm*—Burns, Doane, Swecker & Mathis, LLP

[57] ABSTRACT

In a slab continuous casting machine comprising a tundish for reserving a molten steel therein, a nozzle holding cassette disposed on an outer bottom portion of the tundish, a mold for use in a casting, and an immersing nozzle mounted in the nozzle holding cassette and for pouring the molten steel in the tundish into the mold, the cavity has a generally rectangular sectional shape defined by a pair of short sides and a pair of long sides. When the immersing nozzle is inserted into the mold and when the immersing nozzle is taken out from the mold, a movement of the immersing nozzle gripped by a handling arm in the mold is limited in a direction parallel to the pair of short sides.

13 Claims, 15 Drawing Sheets

SLAB CONTINUOUS CASTING MACHINE HAVING IMMERSING NOZZLE REPLACING APPARATUS AND METHOD OF REPLACING IMMERSING NOZZLE

BACKGROUND OF THE INVENTION

The present invention relates to a slab continuous casting machine, and more specifically to a slab continuous casting machine having an immersing nozzle replacing apparatus and a method of replacing an immersing nozzle.

The slab continuous casting machine described below is defined as the continuous casting machine for casting a slab of about 200 mm or less thick.

The conventional continuous casting machine has been typically used for casting the slab of 200 mm or more thick. However, there has been a recent tendency to directly cast the thin slab of 200 mm or less thick. This is because the thinner slab can omit a rolling process performed by a rolling mill in a subsequent step, although an end product cannot be directly cast by the continuous casting machine.

On the other hand, in the continuous casting machine, an immersing nozzle is essential to stably pour a molten steel from a tundish into a mold. A frequency of tundish maintenance greatly depends on a life of the immersing nozzle. A capability to replace the immersing nozzle during a casting is therefore important in order to reduce the frequency of tundish maintenance.

In the continuous casting machine for casting the slab of 200 mm or more thick, a replacement of the immersing nozzle during the casting is already carried out. For the replacement of the immersing nozzle, a nozzle holding cassette is disposed on an outer bottom portion of the tundish. A handling arm for gripping and carrying the immersing nozzle is also disposed near the mold. The replacement of the immersing nozzle in the continuous casting machine is performed in the following manner. During the casting, an operator operates the handling arm, whereby the new immersing nozzle is attached into the nozzle holding cassette and the old immersing nozzle is then removed from the nozzle holding cassette. The conventional handling arm is freely movable and does not include a guide mechanism for limiting a movement of the immersing nozzle in the mold. This is because a sufficient space between an inner wall of the mold and the immersing nozzle permits a little possibility that the immersing nozzle breaks a solidified shell of the molten steel formed in the mold.

However, in the slab continuous casting machine for casting the slab of 200 mm or less thick, since a distance between the immersing nozzle and the inner wall of the mold is shorter, the replacement of the immersing nozzle during the casting is not carried out. That is, in the slab continuous casting machine, when the replacement of the immersing nozzle is attempted by the use of the above-described handling arm, the following problem arises. Since the space between the inner wall of the mold and the immersing nozzle is very small, even if a little mistake in an operation of the handling arm occurs, the immersing nozzle is caused to come into contact with the solidified shell of the molten steel. This causes an accident in which the solidified shell is broken.

SUMMARY OF THE INVENTION

Thus, it is an object of the present invention to provide a slab continuous casting machine having an immersing nozzle replacing apparatus which is capable of replacing an immersing nozzle during a casting.

It is another object of the present invention to provide a slab continuous casting machine having an immersing nozzle replacing apparatus which is capable of replacing the immersing nozzle without breaking a solidified shell in a mold even if a space between an inner wall of the mold and the immersing nozzle is very small.

It is a still another object of the present invention to provide a method of replacing the immersing nozzle suitable for the above-described slab continuous casting machine.

A slab continuous casting machine according to the present invention comprises a tundish for reserving a molten steel therein, a nozzle holding cassette disposed on an outer bottom portion of the tundish, a mold for use in a casting, an immersing nozzle mounted in the nozzle holding cassette and for pouring the molten steel in the tundish into the mold, and a handling arm for gripping an upper portion of the immersing nozzle so as to thereby move the immersing nozzle. The immersing nozzle extends from the nozzle holding cassette into a cavity of the mold. The cavity has a generally rectangular sectional shape defined by a pair of short sides and a pair of long sides.

According to an aspect of the present invention, the handling arm includes a roller disposed on its tip end. In order to guide the roller, a guide rail is disposed over the mold so that it may extend parallel to the long sides of the cavity. The guide rail includes an inlet side guide rail disposed near one side of a pair of short sides of the mold in order to guide the roller when the immersing nozzle gripped by the handling arm is attached into the nozzle holding cassette. The guide rail further includes an outlet side guide rail disposed near the other side of a pair of short sides of the mold in order to guide the roller when the immersing nozzle is removed from the nozzle holding cassette by the handling arm. When the immersing nozzle is inserted into the mold and when the immersing nozzle is taken out from the mold, a movement of the immersing nozzle gripped by the handling arm in the mold is limited in a direction parallel to a pair of short sides.

A method of replacing the immersing nozzle according to the present invention is applied to the above-mentioned slab continuous casting machine. According to another aspect of the present invention, the method comprises the steps of, when a new immersing nozzle is attached into the nozzle holding cassette, gripping the new immersing nozzle by the handling arm so as to thereby keep the new immersing nozzle horizontal; placing the roller on the inlet side guide rail; carrying, over the mold, the new immersing nozzle which is kept horizontal by guiding the roller by the inlet side guide rail and horizontally moving the handling arm gripping the new immersing nozzle; and rotating the new immersing nozzle about a support of the upper portion thereof so as to thereby insert the new immersing nozzle into the mold. Thus, the movement of the new immersing nozzle gripped by the handling arm in the mold is limited in the direction parallel to a pair of short sides by the inlet side guide rail.

On the other hand, the method further comprises the steps of, when the immersing nozzle is removed from the nozzle holding cassette, placing the roller of the handling arm on the outlet side guide rail; gripping the immersing nozzle by the handling arm, rotating the immersing nozzle about a support of the upper portion thereof and thus keeping the immersing nozzle horizontal so as to thereby take out the immersing nozzle from the mold; and guiding the roller by the outlet side guide rail while horizontally moving the handling arm so as to thereby carry out the immersing nozzle to a position apart from the mold. Thus, the movement of the immersing nozzle gripped by the handling arm in the mold is limited in the direction parallel to a pair of short sides by the outlet side guide rail.

DESCRIPTION OF THE PREFERRED EMBODIMENTS

Figure 1:
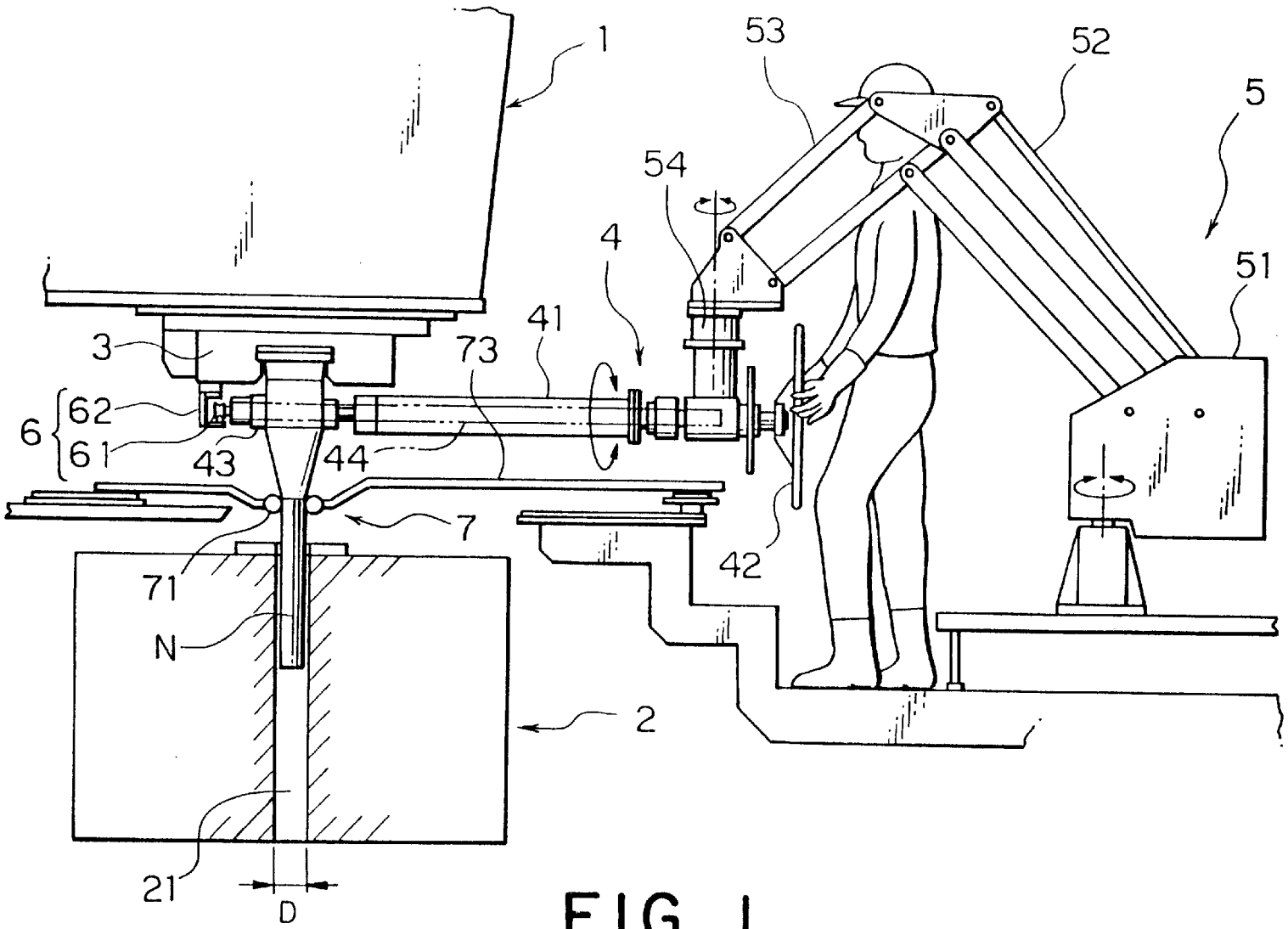
FIG. 1 is an illustration for describing a slab continuous casting apparatus according to a first embodiment of the present invention.

For a better understanding of the present invention, a conventional continuous casting apparatus will be described. A mold of the continuous casting apparatus has a cavity. The cavity has a sectional shape defining a shape of a slab. In the following description, the cavity has a generally rectangular sectional shape defined by a pair of short sides and a pair of long sides. A direction parallel to the short sides is referred to as a thickness direction of the mold. A direction parallel to the long sides, that is, a direction perpendicular to the thickness direction, is referred to as a width direction of the mold.

In the conventional continuous casting apparatus, the following two methods are adopted in order to supply a molten steel from a tundish to a mold. In a first method, an opening is disposed on a bottom portion of the tundish so that the molten steel may flow out from the opening. A slide gate is disposed on a lower side of the opening. An immersing nozzle is mounted on a lower end of the slide gate. The slide gate is horizontally moved, whereby an opening degree of the opening is adjusted. Thus, an amount of the molten steel flowing out from the opening is adjusted. The molten steel is therefore supplied to the mold through the immersing nozzle.

In a second method, the opening is disposed on the bottom portion of the tundish so that the molten steel may flow out from the opening. A stopper for adjusting the opening degree of the opening is disposed inside the tundish. On the lower side of the opening, the immersing nozzle is mounted for guiding the molten steel in the tundish and for supplying the molten steel to the mold. The stopper is moved upward and downward in the tundish, whereby the opening degree of the opening is adjusted. Thus, the amount of the molten steel flowing out from the opening is adjusted. The molten steel is therefore supplied to the mold through the immersing nozzle.

When the molten steel is supplied from the tundish into the mold, the immersing nozzle prevents the molten steel from coming into contact with an atmosphere and from oxidizing. The immersing nozzle also prevents a lubricant powder from being put into the molten steel in the mold due to a flow of the molten steel. Thus, the immersing nozzle is used with its lower end immersed in the molten steel in the mold. The powder is supplied so that it may cover an upper surface of the molten steel supplied into the mold. The powder prevents the molten steel from oxidizing due to an air, while it has a heat insulating function between the air and the molten steel. The powder also functions as a lubricant between an inner wall of the mold and a solidified shell drawn from the mold.

In this case, the immersing nozzle is sometimes molten-broken or eroded due to the powder and the molten steel flow. The immersing nozzle is also sometimes clogged, since an alumina or the like contained in the molten steel flow passing through the mold adheres to the inner wall of the immersing nozzle. In this case, a casting must be stopped.

Recently, in order to improve productivity in a continuous casting and to reduce a tundish maintenance cost, an apparatus for replacing the immersing nozzle clogged or molten-broken during the casting by a new immersing nozzle has been proposed.

For example, as the apparatus applied to the aforementioned first method, an immersing nozzle quick change system is disclosed in Shinagawa-Giho, Vol. 38, 1995.

On the other hand, the apparatus applied to the aforementioned second method is disclosed in Japanese Patent Application Laid-open No. 4-251641/1992.

The above-described immersing nozzle quick change system is arranged in the following manner.

A guide arm capable of supporting three immersing nozzles is mounted on the lower end of a rod of an air cylinder for holding the immersing nozzle. The guide arm is provided with a groove so that a case holding the immersing nozzle may be slidable in the width direction of the mold. On the side where the immersing nozzle is inserted, a cylinder for replacing the immersing nozzle is also mounted in the tundish so that it may be swingable.

When the immersing nozzle is replaced, the slide gate is once closed so as to thereby stop a feed of the molten steel. After a replacement of the immersing nozzle, the slide gate is opened. A time required for this replacing operation is 7 to 8 seconds. The replacement is accomplished without stopping a drawing-out of the slab.

The apparatus disclosed in Japanese Patent Application Laid-open No. 4-251641/1992 relating to the above-described second method is arranged in the following manner. A guide rail is disposed vertically in a direction perpendicular to the width direction of the mold. A carrying truck (hereinafter, referred to as a carrying apparatus) is moved on this guide rail, whereby the immersing nozzle is carried into the mold. During the replacement of the immersing nozzle, the immersing nozzle is pushed into an immersing nozzle holding cassette by means of the cylinder. The immersing nozzle is placed on the carrying apparatus by an operator.

When the above-described immersing nozzle replacing apparatus is used so as to replace the immersing nozzle during the continuous casting, the feed of the molten steel is once stopped for the replacement. Therefore, during the replacing operation, it is essential to reduce a casting velocity within such a range that the slab is not removed from the mold. In the above-described Giho and publication, there is no disclosure about important respects such as an applicable size of the mold (a thickness and a width of the cavity), an increase of the casting velocity before and after the replacement and a method of controlling a level of the molten steel in the mold.

On the other hand, when the replacement of the immersing nozzle in the continuous casting is performed in a conventionally large cavity space, even if the immersing nozzle is deflected in the thickness direction of the mold, no problem arises. In this case, the cavity space has a dimension of 200 to 300 mm in the thickness direction of the mold and a dimension of 1200 to 2300 mm in the width direction in size.

However, the mold, which is applied to a manufacturing process of a steel product in a recent electric furnace industry and is for manufacturing a hot rolled steel plate and a cold rolled steel plate, has the cavity whose size is 150 mm or less in the thickness direction and is 900 to 1600 mm in the width direction. Attention is directed to a method of manufacturing the slab by a high-speed casting at 2 to 5 m/min by the use of the mold having such a cavity. This method is used for a practical production.

In this case, the dimension of the cavity in the thickness direction of the mold is smaller than that of the conventional mold. On the other hand, the sectional shape of the immersing nozzle is also changed from a circular shape to a flat shape. This means that a melting-breaking and a clogging of the immersing nozzle occur rapidly. Therefore, in a continuous casting machine using the mold having the cavity whose dimension is smaller in the thickness direction, the replacement frequency of the immersing nozzle is greater than the replacement frequency of the immersing nozzle in the conventional continuous casting machine.

However, in the continuous casting machine using the mold having the cavity whose dimension is 150 mm or less in the thickness direction, when the immersing nozzle is replaced during the continuous casting, if the above-mentioned immersing nozzle replacing apparatus is used, the following problems occur.

A. Since the dimension of the cavity is smaller in the thickness direction, the immersing nozzle is inserted into the mold in the width direction of the cavity. However, since there is no guide for carrying the immersing nozzle onto the guide (rail) of the immersing nozzle replacing apparatus, the immersing nozzle is deflected whereby it comes into contact with or breaks the solidified shell. In this case, the powder is brought into the solidified shell. This causes not only a deterioration of a slab quality but also a breakout.

B. When the sectional shape of the cavity of the mold is smaller (the cavity has the smaller dimension in the thickness direction), another problem is as follows. That is, immediately before the replacement of the immersing nozzle, the feed from the tundish to the mold is once stopped or an amount of the feed of the molten steel is reduced whereby the casting velocity is reduced. At this time, since the molten steel in the mold has a lower heat capacity, a flow velocity of the level of the molten steel is temporarily reduced or stopped. Thus, a surface temperature of the molten steel is reduced. When the surface temperature of the molten steel is reduced, the level is thinly solidified so as to thereby result in the deterioration of the slab quality. In addition, a failure in melting of the powder is caused, and thus a lubricant function is lost. The solidified shell is constrained to (seized with) a mold copper plate. This causes the breakout. On the other hand, a reduction of the casting velocity results in the reduction of the temperature of the slab. This is not desirable in view of a high-temperature piece formation which is one of aims of a high-speed casting and an energy saving by a rolling.

C. A still another problem is the method of controlling the level of the molten steel in the mold before and after the replacement of the immersing nozzle. In case of the conventional mold, a molten steel level control may be accomplished only by the use of a single eddy-flow type level meter which makes a quick response and has a high level control accuracy. However, when the replacement of the nozzle is performed without reducing the casting velocity and stopping the feed of the molten steel during the continuous casting, more specifically, during the continuous casting of the slab whose width dimension is narrower, the above-described eddy-flow type level meter is an obstacle to the replacement.

D. A further problem is that the unmolten powder enters the immersing nozzle from an outlet port of the immersing nozzle when the new immersing nozzle to be replaced is inserted into the molten steel in the mold. When the unmolten powder enters the immersing nozzle from the outlet port of the immersing nozzle, the following phenomenon occurs. That is, immediately after the replacement of the immersing nozzle, when the molten steel drops in the immersing nozzle in which the molten steel flow is temporarily interrupted, the unmolten powder is rapidly heated due to a heat of the molten steel and thus a reactive gas is blown out. This causes a splash fly, a variation in the molten steel level with the splash fly and the deterioration of cleanability of the molten steel.

Figure 2:
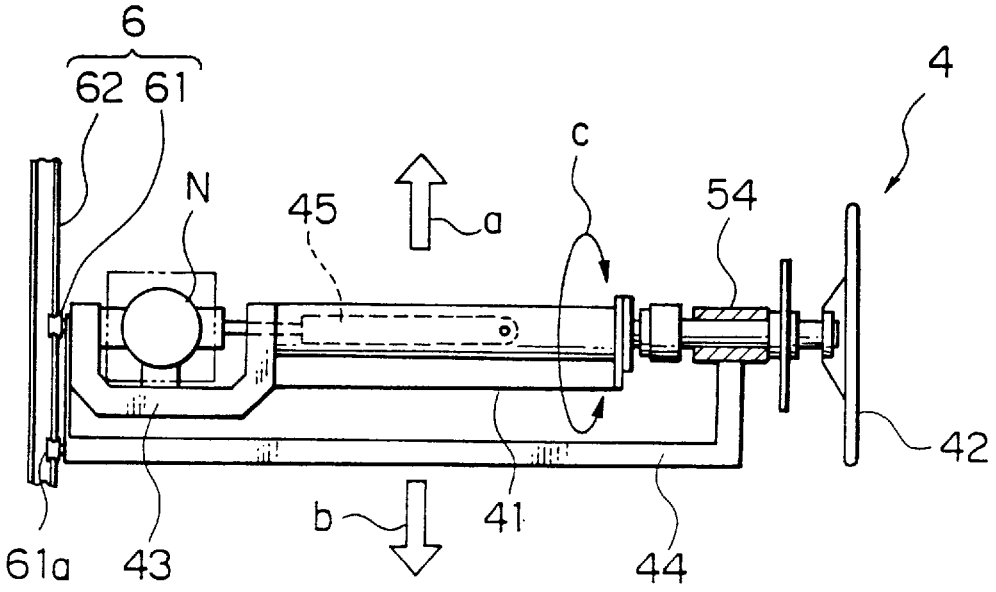
FIG. 2 is a plan view showing a handling arm and an arm guide shown in FIG. 1.

Referring to FIGS. 1 through 4, a slab continuous casting machine according to a first embodiment of the present invention will be described. In FIGS. 1 and 2, the slab continuous casting machine includes a tundish 1 and a mold 2 located below the tundish 1. A nozzle holding cassette 3 is disposed on an outer bottom portion of the tundish 1. Beside the tundish 1, a handling arm 4 extending toward the nozzle holding cassette 3 is disposed. The handling arm 4 is coupled to an arm drive auxiliary apparatus 5. The mold 2 has a cavity 21 for casting the slab of 200 mm or less thick.

Reference symbol D shown in FIG. 1 denotes the dimension of the cavity in the thickness direction. Since an arrangement of the nozzle holding cassette 3 is well known, a detailed description is omitted. In the following description, in the replacement of the immersing nozzle represented by reference symbol N in FIG. 1, the immersing nozzle attached to the nozzle holding cassette 3 is referred to as a new immersing nozzle. The immersing nozzle removed from the nozzle holding cassette 3 is referred to as an old immersing nozzle. The immersing nozzle N is flatly shaped so that the upper portion thereof may be cylindrical and the lower portion thereof may have a generally rectangular sectional shape.

The slab continuous casting machine further includes the immersing nozzle replacing apparatus for attaching the new immersing nozzle to the nozzle holding cassette 3 and for removing the old immersing nozzle from the nozzle holding cassette 3. The immersing nozzle replacing apparatus moves the immersing nozzle in a direction perpendicular to a surface of FIG. 1 while performing the replacement. The handling arm 4 includes a rotatable arm body 41, a handle 42 for rotating the arm body 41, a clamp mechanism 43 disposed in the arm body 41 and for gripping the upper portion of the immersing nozzle and an auxiliary arm 44 extending parallel to the arm body 41. The handling arm 4 is a mechanism for performing the replacement by the operator by operating the handle 42 and gripping the immersing nozzle N. The detail will be described below.

The arm drive auxiliary apparatus 5 can support and freely move the handling arm 4 by a combination of a gyrating movement of a base 51, a rising and falling movement of a link 52 coupled to the base 51 and a link 53 coupled to the link 52 and the gyrating movement of a support bracket 54 disposed on the tip end of a link 53. Thus, the handling arm 4 is supported by the arm drive auxiliary apparatus 5 by coupling base ends of the arm body 41 and the auxiliary arm 44 to the support bracket 54. The operator grips and moves the handle 42 in the direction perpendicular to the surface of FIG. 1 (the direction shown by arrows a, b in FIG. 2), whereby the handling arm 4 can be moved in that direction.

An immersing nozzle preheater (not shown in FIG. 1) is located behind the mold 2. The immersing nozzle preheater is for preheating the new immersing nozzle. Since this is also well known, the detailed description is omitted.

By the use of a driving force of the arm drive auxiliary apparatus 5, the operator can grip the new immersing nozzle by the handling arm 4 and carry the new immersing nozzle from the immersing nozzle preheater to the nozzle holding cassette 3. The operator can also remove the old immersing nozzle from the nozzle holding cassette 3 by the handling arm 4 and carry the old immersing nozzle to a position apart from the nozzle holding cassette 3 for temporarily placing the immersing nozzle thereon.

As shown in detail in FIG. 2, the base end of the arm body 41 is rotatably mounted to the support bracket 54. On the tip end of the arm body 41, the clamp mechanism 43 for gripping the immersing nozzle is mounted. A clamp cylinder mechanism 45 is incorporated in the arm body 41 as a driving source of the clamp mechanism 43.

The clamp mechanism 43 can clamp and unclamp the upper portion of the immersing nozzle N. The clamp mechanism 43 can be rotated as shown by an arrow c by the operation of the handle 42. As described above, the clamp mechanism 43 can be also moved in the direction shown by the arrows a, b together with the arm body 41. On the tip end of the arm body 41, a roller 61 for constituting an arm guide 6 is mounted.

An auxiliary roller 61*a* is disposed on the tip end of the auxiliary arm 44 extending parallel to the arm body 41. As a result, the tip end of the handling arm 4 can be supported on two points on a guide rail 62. Accordingly, it is possible to keep the state that the handling arm 4 orthogonally extends from the guide rail 62, when the operator tries to rotate the immersing nozzle N by the handle 42 with the handling arm 4 moved in the direction shown by the arrows a, b. This means that the movement of the handling arm 4 in the direction shown by the arrows a, b is facilitated. Furthermore, this means that it is possible to rotate the immersing nozzle N clamped by the clamp mechanism 43 along with the inner walls in the long sides of the mold 2.

In this embodiment, a motor M (see FIG. 3) for driving the roller 61 is incorporated in the arm body 41. However, the roller may be implemented by a free roller which is not combined with the motor. An actuating switch (not shown) for performing a start/stop of the motor M and a switch (not shown) for switching a forward/reverse rotation of the motor M are also disposed. As a result, the roller 61 can be rotated by means of the motor M. The movement of the handling arm 4 can be more smoothly performed.

Figure 3:
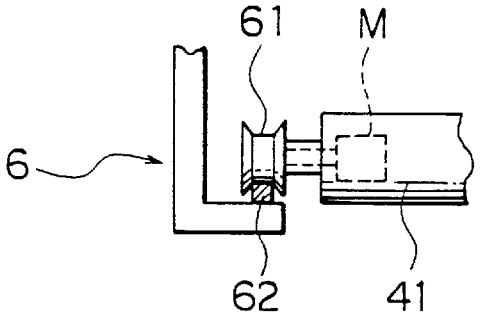
FIG. 3 is an enlarged side view of the arm guide shown in FIG. 2.
Figure 5:
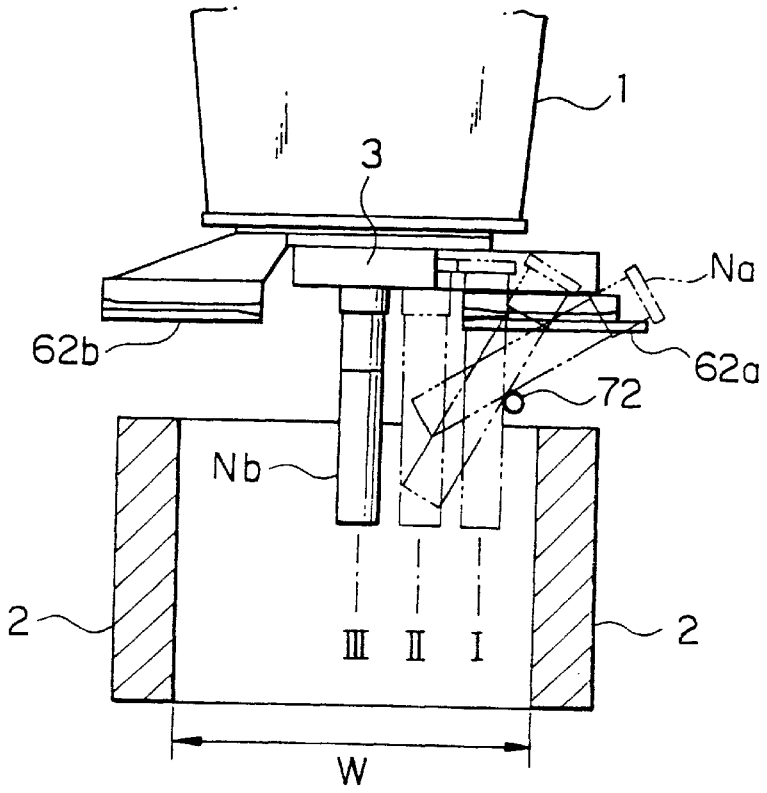
FIG. 5 is an illustration for describing an operation when a new immersing nozzle is inserted into a mold by the use of a nozzle replacing apparatus according to the first embodiment of the present invention.

In FIGS. 2 and 3, although the guide rail 62 is installed in the arm guide 6 disposed in the nozzle holding cassette 3, the guide rail 62 may be disposed on the outer bottom portion of the tundish 1. As shown in FIG. 5, the guide rail 62 is disposed on both of an inlet side and an outlet side of the nozzle holding cassette 3. Hereinafter, the guide rail located on the inlet side is referred to as an inlet side guide rail 62*a*. The guide rail located on the outlet side is referred to as an outlet side guide rail 62*b*.

When the old immersing nozzle is replaced by the new immersing nozzle, the movement of the handling arm 4 allows the roller 61 to be rotationally moved on the inlet side guide rail 62*a* or the outlet side guide rail 62*b*, whereby the handling arm 4 is guided. In other words, in FIG. 1, the vertical and horizontal movements of the handling arm 4 are limited. Therefore, as shown in FIG. 1, when the immersing nozzle N gripped by the handling arm 4 is inserted into the cavity 21 of the mold 2, the horizontal movement (in a direction of the thickness D of the cavity 21) and vertical movement are limited. This means that the immersing nozzle N does not come into contact with the solidified shell in the cavity 21 of the mold 2.

Figure 4:
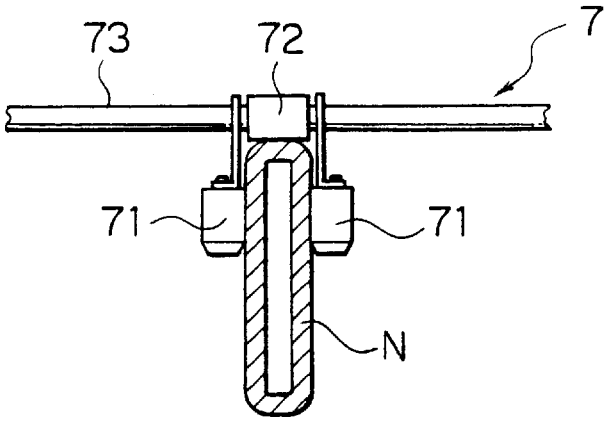
FIG. 4 is a plan view of a nozzle guide shown in FIG. 1.

Over the mold 2, a nozzle guide 7 shown in FIGS. 1 and 4 is located. The nozzle guide 7 comprises a pair of guide rollers 71, 71 for limiting the movement of the immersing nozzle N in the direction of the thickness D and an auxiliary guide roller 72 for guiding an insertion during the insertion of the immersing nozzle N into the mold 2. The guide rollers 71 and the auxiliary guide roller 72 are mounted in a support arm 73. The nozzle guide 7 shown in FIGS. 1 and 4 is used when the immersing nozzle N is inserted into the mold 2. The nozzle guide 7 is located on the inlet side of the nozzle holding cassette 3. On the other hand, when the immersing nozzle is taken out from the mold 2, the similar nozzle guide is also used. This nozzle guide is located on the outlet side of the nozzle holding cassette 3.

The arm guide 6 limits indirectly the movement of the upper portion of the immersing nozzle N through the arm body 41. On the other hand, since the nozzle guide 7 limits directly the movement of the lower portion of the immersing nozzle N, such a greater effect is obtained that the immersing nozzle N may not come into contact with the solidified shell in the mold 2.

Figure 6:
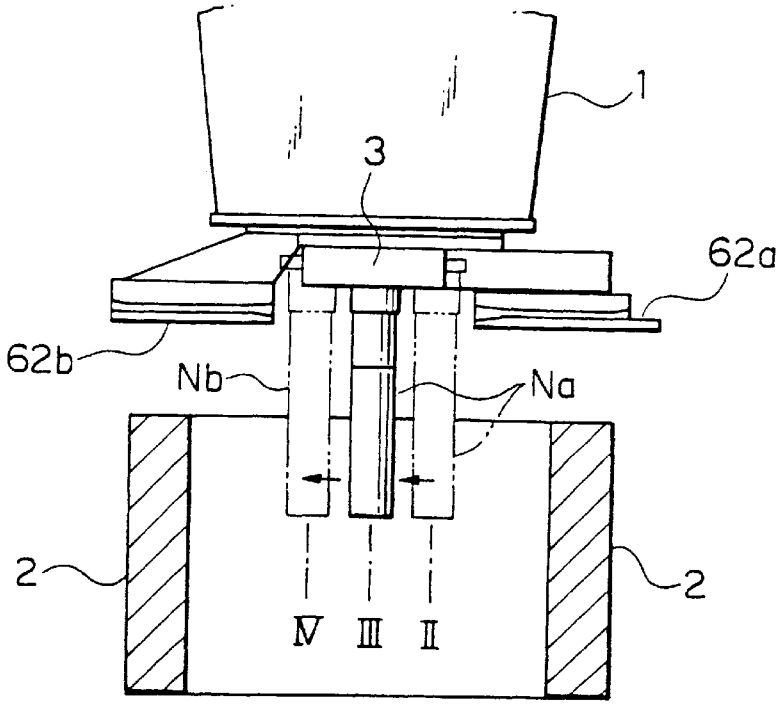
FIG. 6 is an illustration for describing the operation when an old immersing nozzle is replaced by the new immersing nozzle in a nozzle holding cassette.
Figure 7:
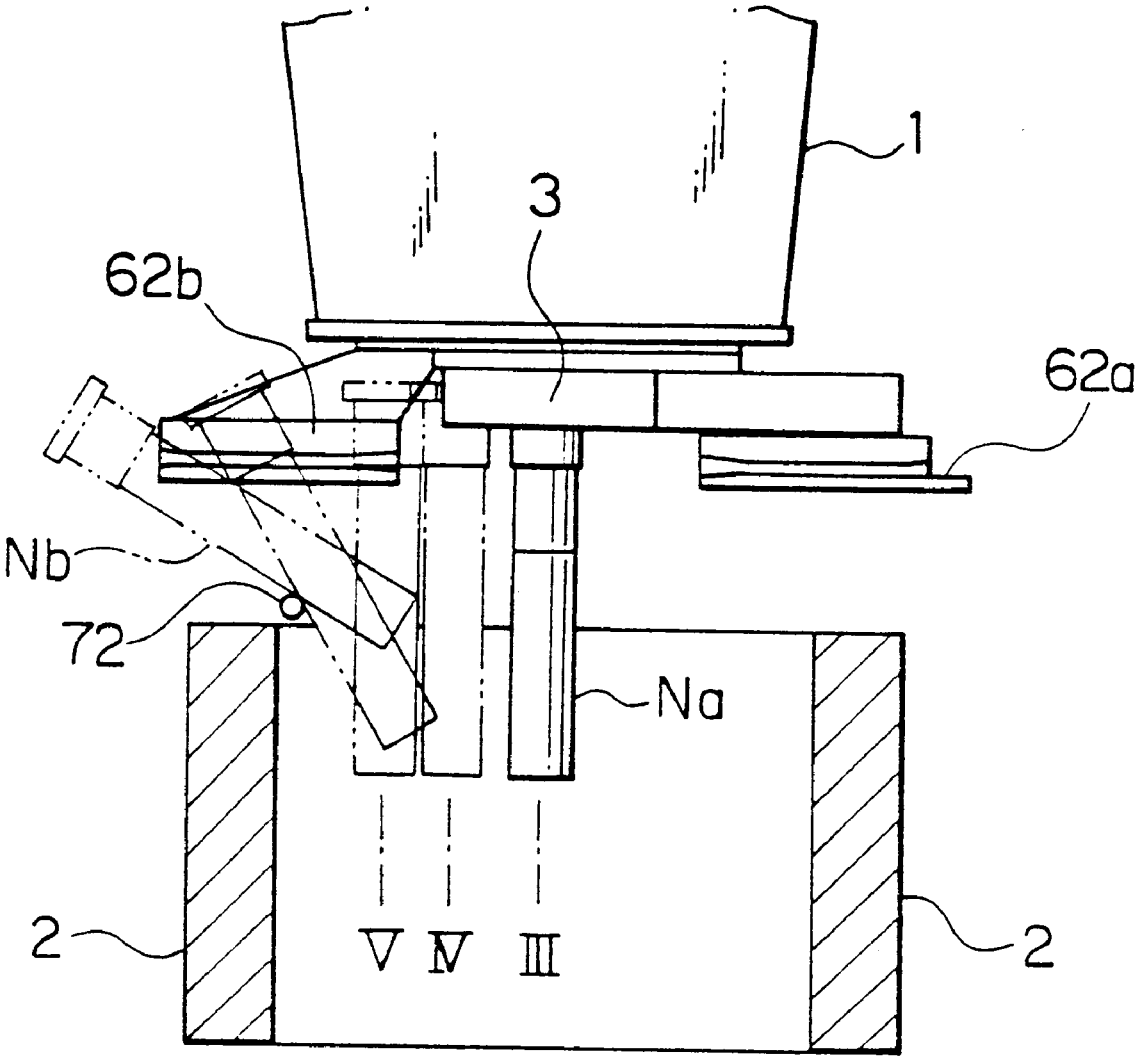
FIG. 7 is an illustration for describing the operation when the old immersing nozzle is taken out from the mold.

Referring to FIGS. 5 through 7, the replacement of the immersing nozzle by the immersing nozzle replacing apparatus will be described. In FIG. 5, reference symbol W denotes the dimension of the cavity 21 of the mold 2 in the width direction. The above-described immersing nozzle preheater is located on the right side of the mold 2 shown in FIG. 5. During the replacement of the immersing nozzle described below, in the tundish 1, a supply of the molten steel to the mold 2 is stopped by the slide gate or the stopper (not shown) described above.

The insertion of the new immersing nozzle is performed in the following manner. The upper portion of the new immersing nozzle in the immersing nozzle preheater is gripped by the clamp mechanism 43 of the handling arm 4. In this state, the roller 61 and the auxiliary roller 61*a* are removed from the inlet side guide rail 62*a*. The handle 42 is held so as to thereby keep a new immersing nozzle Na horizontal while the roller 61 and the auxiliary roller 61*a* are placed on the inlet side guide rail 62*a*. The new immersing nozzle Na is then moved over the mold 2 along the inlet side guide rail 62*a*. Next, the rotation of the handle 42 allows the immersing nozzle Na to be counterclockwise rotated about a support of the upper portion thereof. The immersing nozzle Na is thus inserted into the cavity 21 of the mold 2. At this time, the immersing nozzle Na is inserted between a pair of guide rollers 71 shown in FIG. 4. The insertion of the immersing nozzle Na is guided by the auxiliary guide roller 72. Consequently, the immersing nozzle Na is inserted into the mold 2 with upright-standing. This insertion position is the position by reference numeral I in FIG. 5.

The handling arm 4 is further moved leftward in FIG. 5 from the above-mentioned state, whereby the new immersing nozzle Na is moved to the position shown by reference numeral II. The position shown by II is a standby position where the replacement is started in the nozzle holding cassette 3. During this replacing operation, the movement of the new immersing nozzle Na in the cavity 21 in the thickness direction is limited by the arm guide 6 and the nozzle guide 7. Thus, there is no risk in which the immersing nozzle Na breaks the solidified shell in the mold 2. Until this state, an old immersing nozzle Nb is attached to the nozzle holding cassette 3 and positioned in the position shown by reference numeral III.

Referring to FIG. 6, the replacement of the new immersing nozzle Na and the old immersing nozzle Nb will be described below. In the nozzle holding cassette 3, the replacement of the new immersing nozzle Na and the old immersing nozzle Nb is performed. That is, a hydraulic cylinder (not shown) incorporated in the nozzle holding cassette 3 is actuated so as to thereby press the new immersing nozzle Na. This allows the new immersing nozzle Na to be moved from the standby position II to the use position III. On the other hand, the old immersing nozzle Nb is moved from the use position III to a removal position IV.

Referring to FIG. 7, a carryout of the old immersing nozzle Nb will be described. The old immersing nozzle Nb moved to the removal position IV is clamped by the clamp mechanism 43 of the handling arm 4. The roller 61 and the auxiliary roller 61*a* are thus placed on the outlet side guide rail 62*b*. The handling arm 4 is then guided by the outlet side guide rail 62*b* while it is moved from the removal position IV to a position V. Next, the operation of the handle 42 allows the old immersing nozzle Nb to be counterclockwise rotated while the old immersing nozzle Nb is taken out from the position V. The old immersing nozzle Nb is rotated so that it may be horizontal. In case of such a takeout, the movement of the old immersing nozzle Nb in the cavity 21 in the thickness direction is limited by the outlet side guide rail 62*b* and the auxiliary guide roller 72 located on the outlet side of the nozzle holding cassette 3. Thus, the old immersing nozzle Nb does not come into contact with the solidified shell in the mold 2. When the old immersing nozzle Nb is taken out, if there is a large difference between the dimension of the cavity 21 in the thickness direction and the dimension of the old immersing nozzle Nb in the thickness direction, it is not necessary to perform a limitation by the nozzle guide 7 on the outlet side.

In the above-described embodiment, although the nozzle guide 7 is used in addition to the arm guide 6, the arm guide 6 alone can limit the movement of the immersing nozzle to a large extent. Therefore, the nozzle guide 7 may not be necessarily used.

According to this embodiment, even if the replacement of the immersing nozzle is performed during the casting, the movement of the immersing nozzle in the thickness direction in the cavity of the mold is limited. This can prevent an accident in which the immersing nozzle comes into contact with the solidified shell in the mold. The replacement of the immersing nozzle can be therefore performed during the casting. This allows a tundish maintenance frequency to be reduced.

Next, the slab continuous casting machine and the immersing nozzle replacing method according to a second embodiment of the present invention will be described. Meeting conditions described below is required for the replacement of the immersing nozzle during the continuous casting.

(1) When the immersing nozzle is inserted into the mold, it is not possible to avoid that a center of the immersing nozzle in the thickness direction and a center of the cavity in the mold in the thickness direction are shifted from each other. This shift is permitted by a misalignment allowance (deflection allowance). The misalignment allowance of the immersing nozzle is determined by a value resulting from that the dimension of the immersing nozzle in the thickness direction and the thickness dimension of the solidified shell formed in the mold are subtracted from the dimension of the cavity in the mold in the thickness direction. This value is defined as a limitation condition. The misalignment allowance is within±5 mm, for example, in the continuous casting machine using the mold having the cavity whose dimension is 150 mm or less in the thickness direction.

Figure 8:
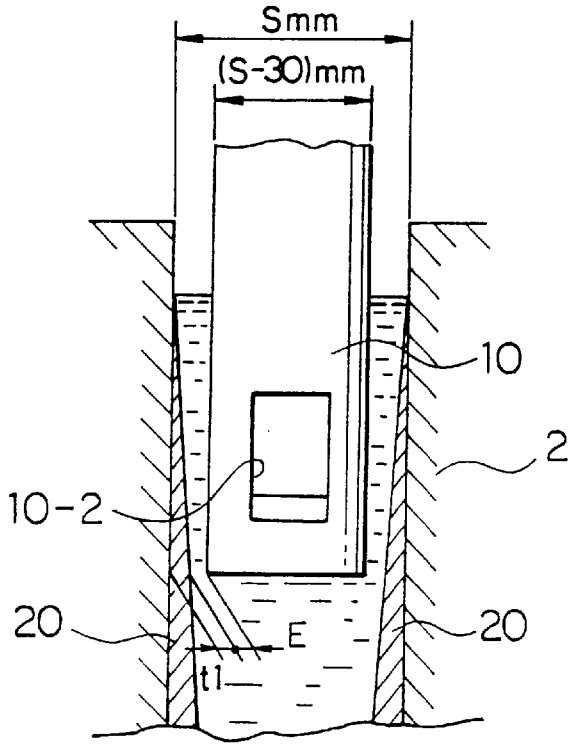
FIG. 8 schematically shows a cross section of the mold during a casting.

The above-described misalignment allowance will be described with reference to FIG. 8. FIG. 8 schematically shows a cross section of the mold 2 during the casting. When an immersing nozzle 10 (thickness: S−30 mm) is inserted into the mold 2 (thickness: S mm), the left and right spaces between the inner wall of the mold 2 and the immersing nozzle 10 are 15 mm, respectively, in FIG. 8. A thickness t of a solidified shell 11 is subtracted from 15 mm described above, whereby the resulting value is the above-mentioned misalignment allowance. This is represented by a space E. A thickness t1 of the solidified shell 11 is determined by the following equation:

$$t1=20(T)^{1/2}=20(H/Vc)^{1/2},$$

where T denotes a time (min), Vc denotes a casting velocity (m/min) and H denotes a distance (m) from a meniscus.

Figure 9:
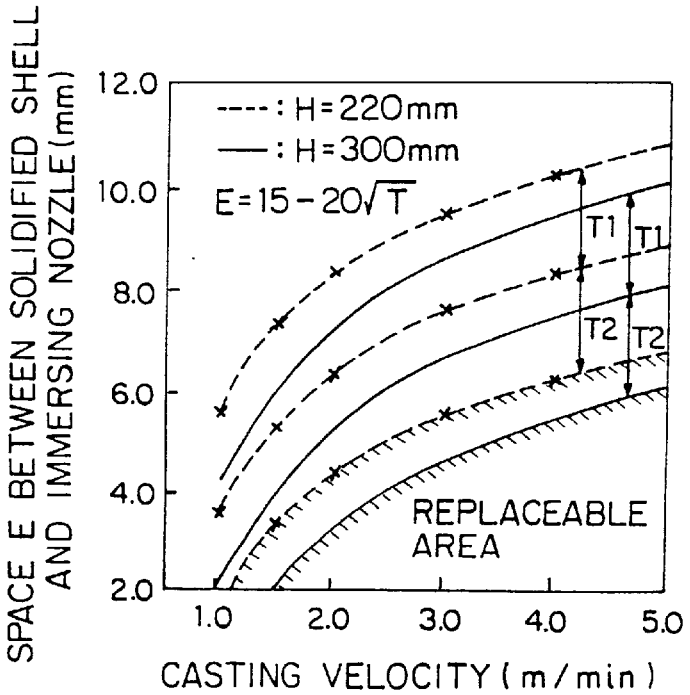
FIG. 9 is a characteristic graph for describing a relationship between a space E between the immersing nozzle and a solidified shell and a casting velocity Vc.
Figure 10:
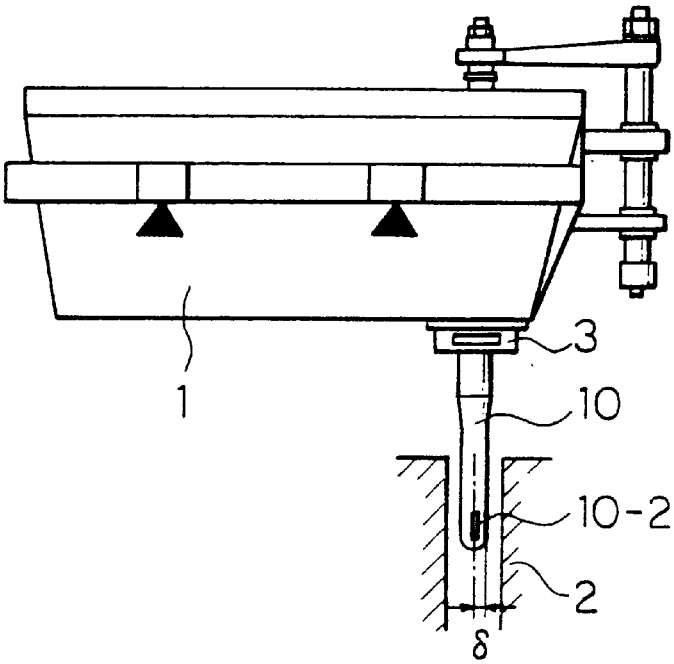
FIG. 10 is an illustration for describing an effect of a heat deformation of a tundish on a tip end position of the immersing nozzle.

FIG. 9 is a graph of an equation representing a relationship between the space E and the casting velocity Vc, $E=15-20(T)^{1/2}$. T1 shown in FIG. 9 represents a range δ (within ±2 mm) in which the position of the tip end of the immersing nozzle 10 is varied with a deformation due to elongation of the tundish 1 during the casting from a preheating. The range δ of the variation in the position of the tip end of the immersing nozzle 10 is shown in FIG. 10. T2 shown in FIG. 9 represents the range of a manufacturing tolerance of the immersing nozzle 10.

Figure 11:
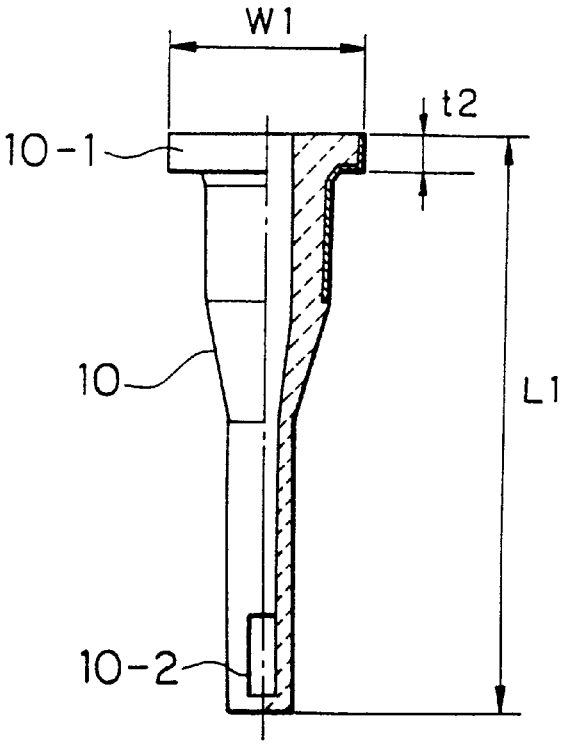
FIG. 11 is a half cross sectional view for describing the immersing nozzle.

As shown in FIG. 11, the immersing nozzle 10 has a head plate 10-1 of a length W1 on the upper end thereof. The immersing nozzle 10 has a total length of L1. The head plate 10-1 has a thickness t2. On a lower end of the immersing nozzle 10, outlet ports 10-2 for the molten steel are disposed so that they may be positioned opposite to each other. With respect to a parallelism of the head plate 10-1 in the direction of the thickness t2 and a squareness of the head plate 10-1 in the direction of the length L1, the tolerance of a manufacturing error of the immersing nozzle 10 is controlled within ±2 mm. Although the least possible manufacturing error is better, if too small, a manufacturing cost is too expensive. Thus, the tolerance is required to some extent.

For example, if the total length L1 is 1030 mm and the parallelism of the head plate 10-1 of the length W1 in the direction of the thickness t2 is 0.1 mm, the deflection of the tip end of the immersing nozzle 10 is expressed by the following equation.

$$(L1/W1)\times 0.1\ mm=(1030/210)\times 0.1=0.5\ mm$$

A perpendicularity indicates a manufacturing work precision of the immersing nozzle 10 and the head plate 10-1. The perpendicularity is within ±1 mm. As another allowance, when the immersing nozzle 10 is attached to a nozzle replacing cassette, the allowance of the space between the head plate 10-1 and the guide of the nozzle replacing cassette is controlled within ±1 mm. In such a manner, the limitation condition is generally satisfied within ±5 mm.

Broken curved lines in FIG. 9 show characteristics when a distance (immersion depth) H from the level to the tip end of the immersing nozzle 10 in FIG. 8 is 300 mm. This is a case in which the dimension of the cavity 21 of the mold 2 in the width direction is larger. On the other hand, solid curved lines in FIG. 9 show the case in which the immersion depth H is similarly 220 mm. This is the characteristics when the width of the cavity 21 of the mold 2 is smaller due to a change in the width during the casting. The immersion depth H is determined depending on the condition of the space between the immersing nozzle 10 and the nozzle holding cassette 3 mounted on the outer bottom portion of the tundish 1, the length of the immersing nozzle 10 or the like. The above-described numerical values such as 300 mm and 220 mm are the values at the time of an experiment.

(2) When the dimension of the cavity 21 of the mold 2 in the width direction is narrowed due to the change in the width during the casting and when the immersing nozzle is replaced in the mold 2 having the cavity 21 whose width is narrow, the space between the outer bottom portion of the tundish 1 and the upper end of the mold 2 is limited depending on the length of the immersing nozzle. In this case, if the tundish 1 is not moved upward, the insertion of the immersing nozzle is sometimes difficult.

(3) When the misalignment allowance is smaller, it is difficult to set the preheated immersing nozzle to the guide of the nozzle replacing cassette by manpower without deflecting the tip end of the immersing nozzle.

Figure 12:
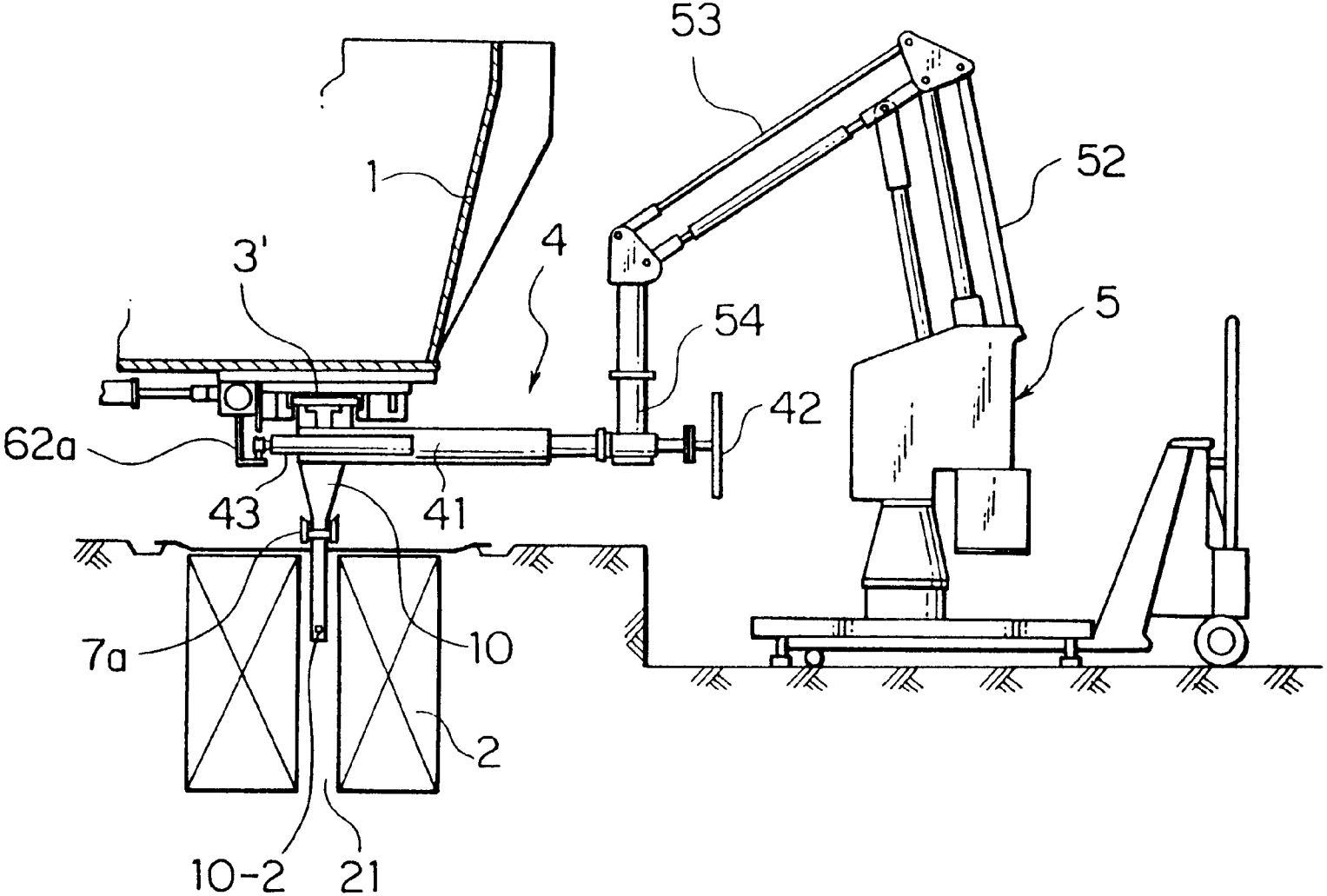
FIG. 12 is an illustration showing a schematic arrangement of the slab continuous casting apparatus according to a second embodiment of the present invention.
Figure 13:
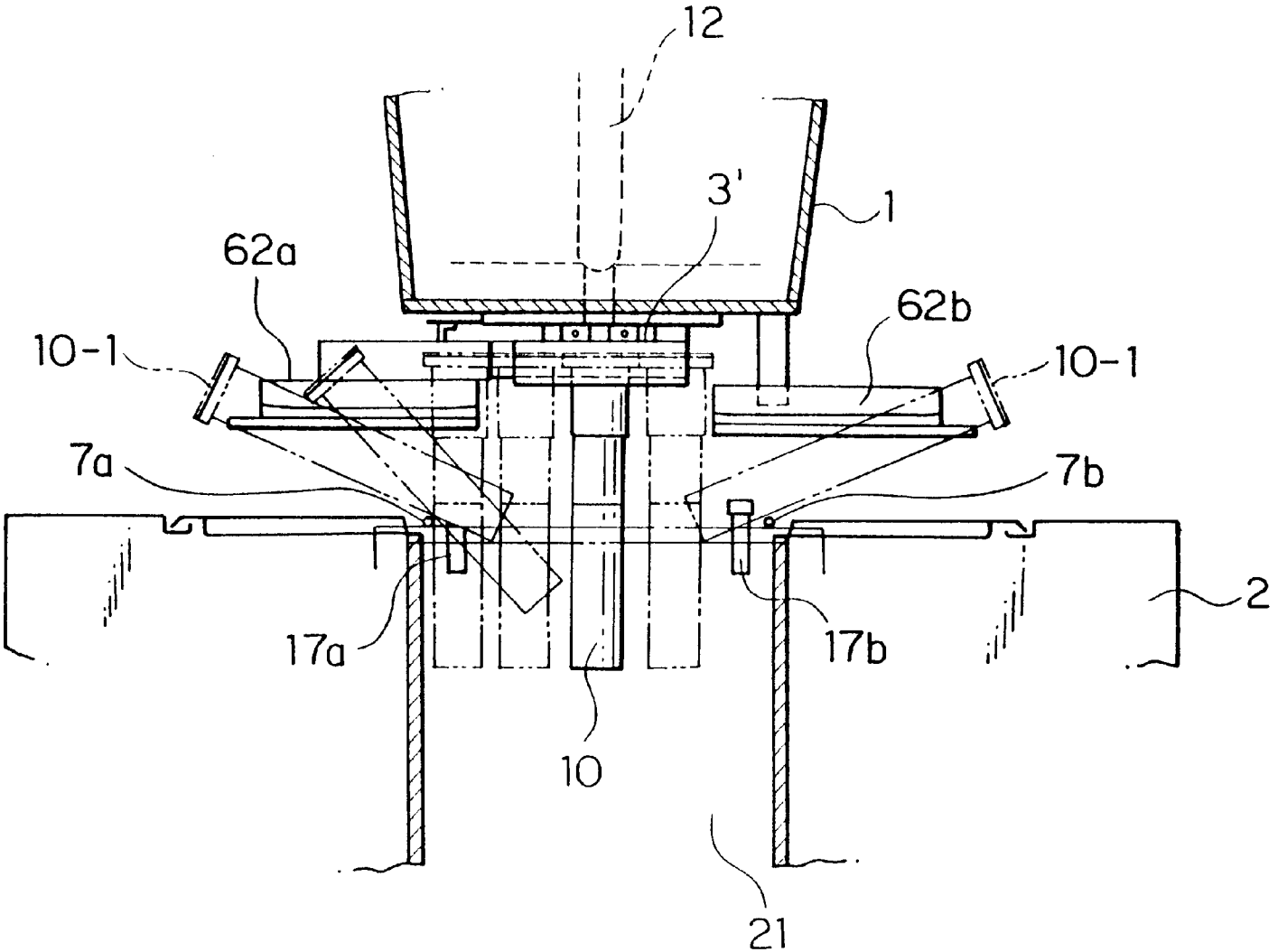
FIG. 13 is a cross sectional view of the arrangement between the tundish and the mold shown in FIG. 12 seen from a side face.

Referring to FIGS. 12 through 17, the slab continuous casting machine meeting the above conditions (1) through (3) will be described. In FIGS. 12 and 13, the same portions as in the above-described first embodiment have the same reference numerals. As can be apparent below, the slab continuous casting machine is provided with a nozzle holding apparatus 3' instead of the nozzle holding cassette 3 shown in FIG. 1. As described above with reference to FIG. 10, the immersing nozzle 10 has the rectangular head plate 10-1 on the upper end thereof. As shown in FIG. 13, in the tundish 1, a stopper 12 as described above is disposed for opening/closing the opening disposed on the bottom portion of the tundish 1.

In FIGS. 12 through 17, the handling arm 4 is combined with the gravity balance type arm drive auxiliary apparatus 5. The arm body 41 of the handling arm 4 is coupled to the support bracket 54 through a bearing. The tip end of the arm body 41 is provided with the clamp mechanism 43 for gripping the head plate 10-1 of the immersing nozzle 10. The handle 42 is horizontally moved, whereby the clamp mechanism 43 can be horizontally moved. The rotation of the handle 42 also allows the clamp mechanism 43 to be rotated. Furthermore, the handle 42 is lifted and lowered, whereby the clamp mechanism 43 can be moved upward and downward.

The inlet side guide rail 62*a* guides the horizontal movement of the arm body 41 so that the head plate 10-1 of the new immersing nozzle gripped by the clamp mechanism 43 may be inserted into a pair of inlet side guides 3*a* of the nozzle holding apparatus 3'. Thus, the inlet side guide rail 62*a* is located on the inlet side guides 3*a* of the nozzle holding apparatus 3'. The outlet side guide rail 62*b* guides the horizontal movement of the arm body 41 so that the old immersing nozzle may be taken out from a pair of outlet side guides 3*b* of the nozzle holding apparatus 3'. Thus, the outlet side guide rail 62*b* is located on the outlet side guides 3*b* of the nozzle holding apparatus 3'.

Figure 15:
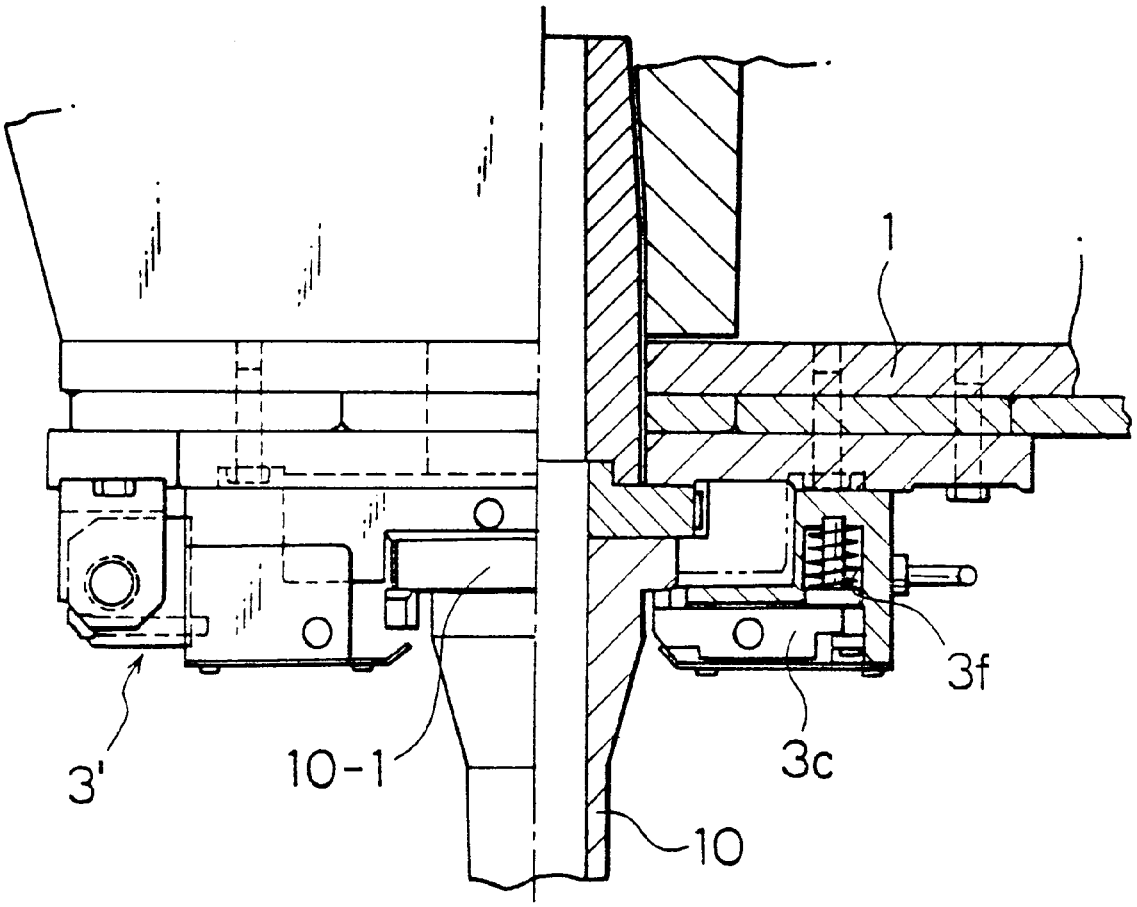
FIG. 15 is a half cross sectional view taken on line A—A of FIG. 14.
Figure 16:
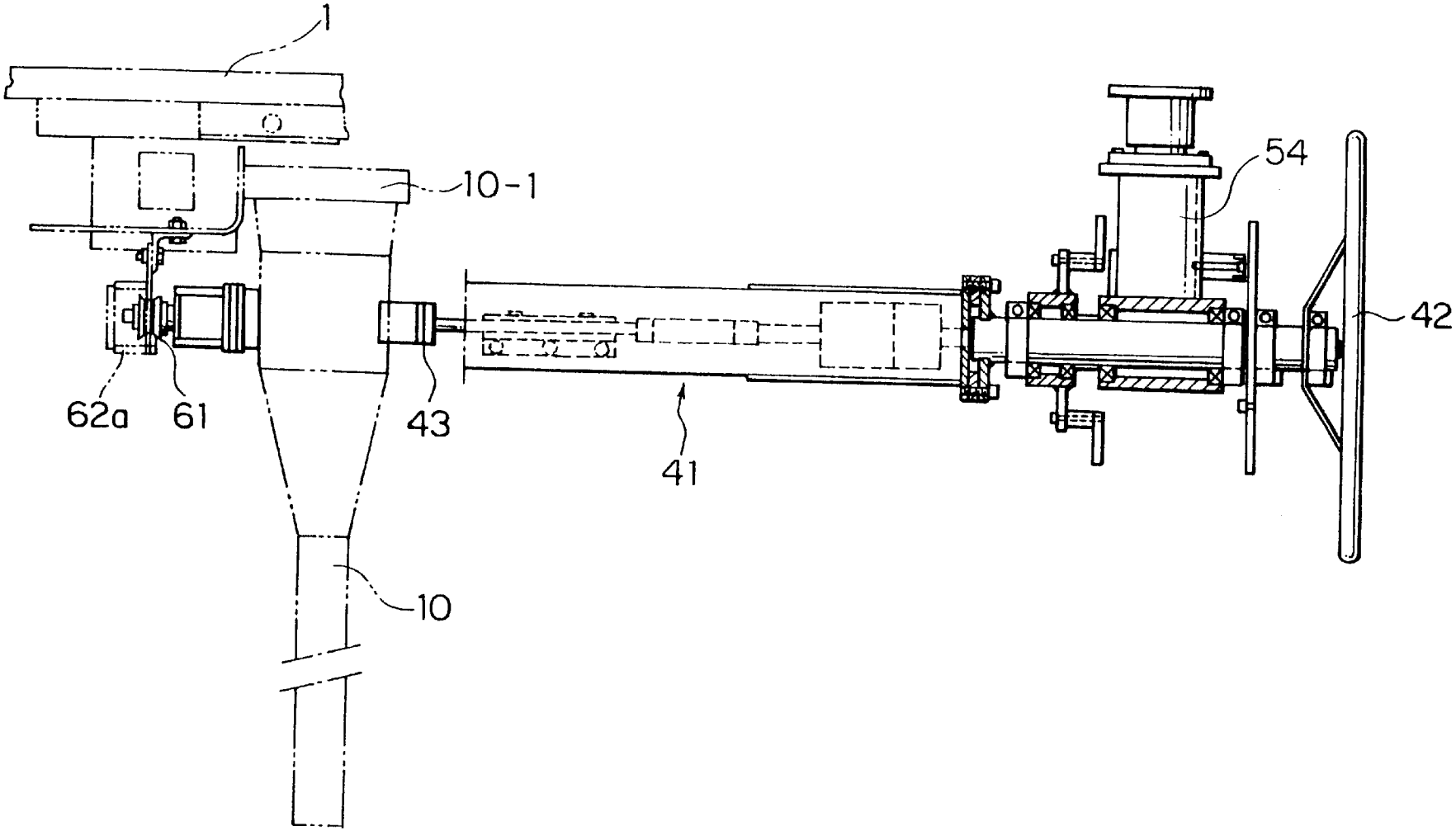
FIG. 16 is an illustration of the handling arm shown in FIG. 1 seen from the side face.
Figure 17:
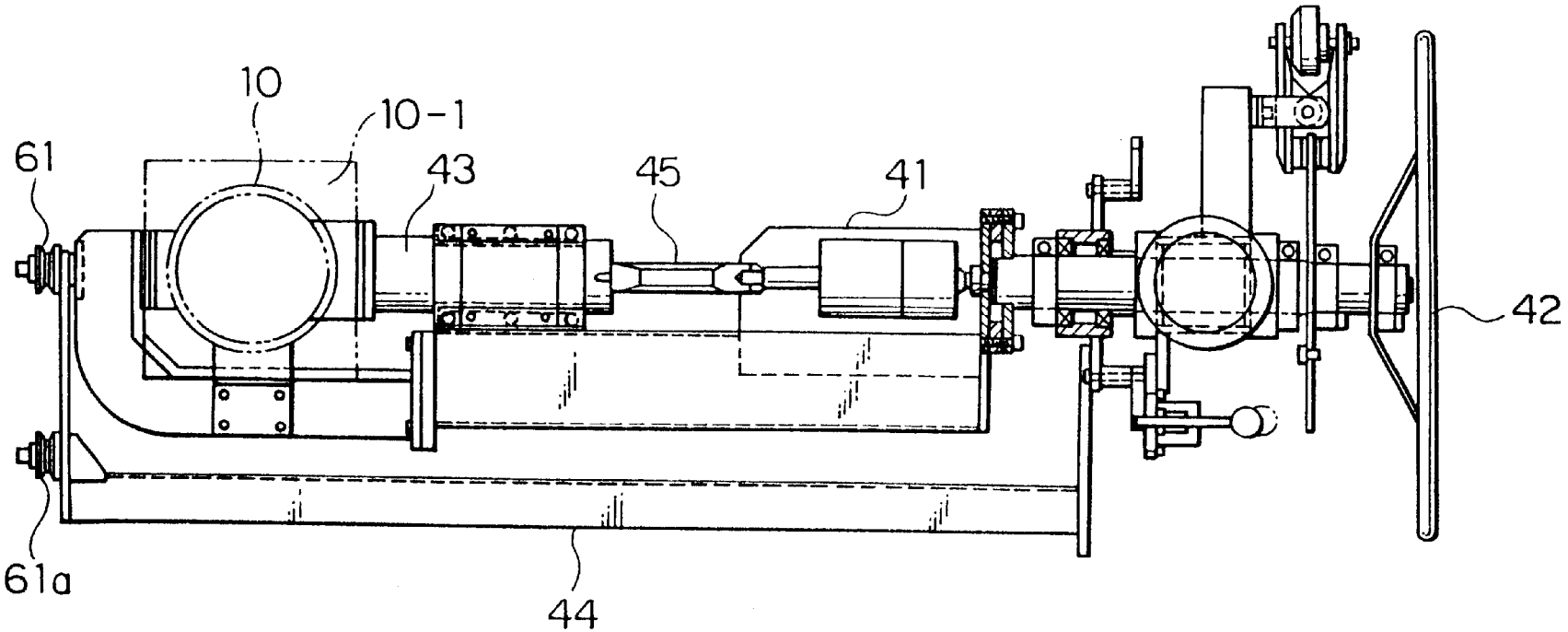
FIG. 17 is a plan view of the handling arm shown in FIG. 16 seen from an upper side.

The nozzle holding apparatus 3' is disposed on the outer bottom portion of the tundish 1. As shown in detail in FIG. 14, in the nozzle holding apparatus 3', a plurality of arms 3*c* for pushing up the head plate 10-1 of the immersing nozzle are also disposed between the inlet side guides 3*a* and the outlet side guides 3*b*. In this embodiment, as shown in FIG. 15, a plurality of arms 3*c* are arranged so that they may be pressed upward by a plurality of compression springs 3*f*. The nozzle holding apparatus 3' further comprises a forcing cylinder 3*d* for forcing the immersing nozzle located in the inlet side guides 3*a* and a withdrawing cylinder 3*e* for withdrawing the forcing cylinder 3*d* to a withdrawal position except for the time of forcing the immersing nozzle. As long as the nozzle holding apparatus 3' is arranged so that it may comprise the forcing cylinder 3*d* and the withdrawing cylinder 3*e*, the nozzle holding apparatus 3' is not limited to the arrangement shown in FIGS. 14 and 15.

As described above with reference to FIG. 4, an inlet side nozzle guide 7*a* is the guide for limiting the movement of the lower portion of the new immersing nozzle and for guiding the rotation when the new immersing nozzle is inserted into the inlet side guides 3*a*. Thus, as shown in FIG. 13, the inlet side nozzle guide 7*a* is located on the inlet side guides 3*a* near the upper end of the mold 2. An outlet side nozzle guide 7*b* is the guide for limiting the movement of the lower portion of the old immersing nozzle and for guiding the rotation when the old immersing nozzle is taken out from the outlet side guides 3*b*. Thus, the outlet side nozzle guide 7*b* is located on the outlet side guides 3*b* near the upper end of the mold 2. Needless to say, the inlet side nozzle guide 7*a* and the outlet side nozzle guide 7*b* are installed at such a height that they may not be in contact with the mold even if the mold 2 is vibrated.

Figure 13A:
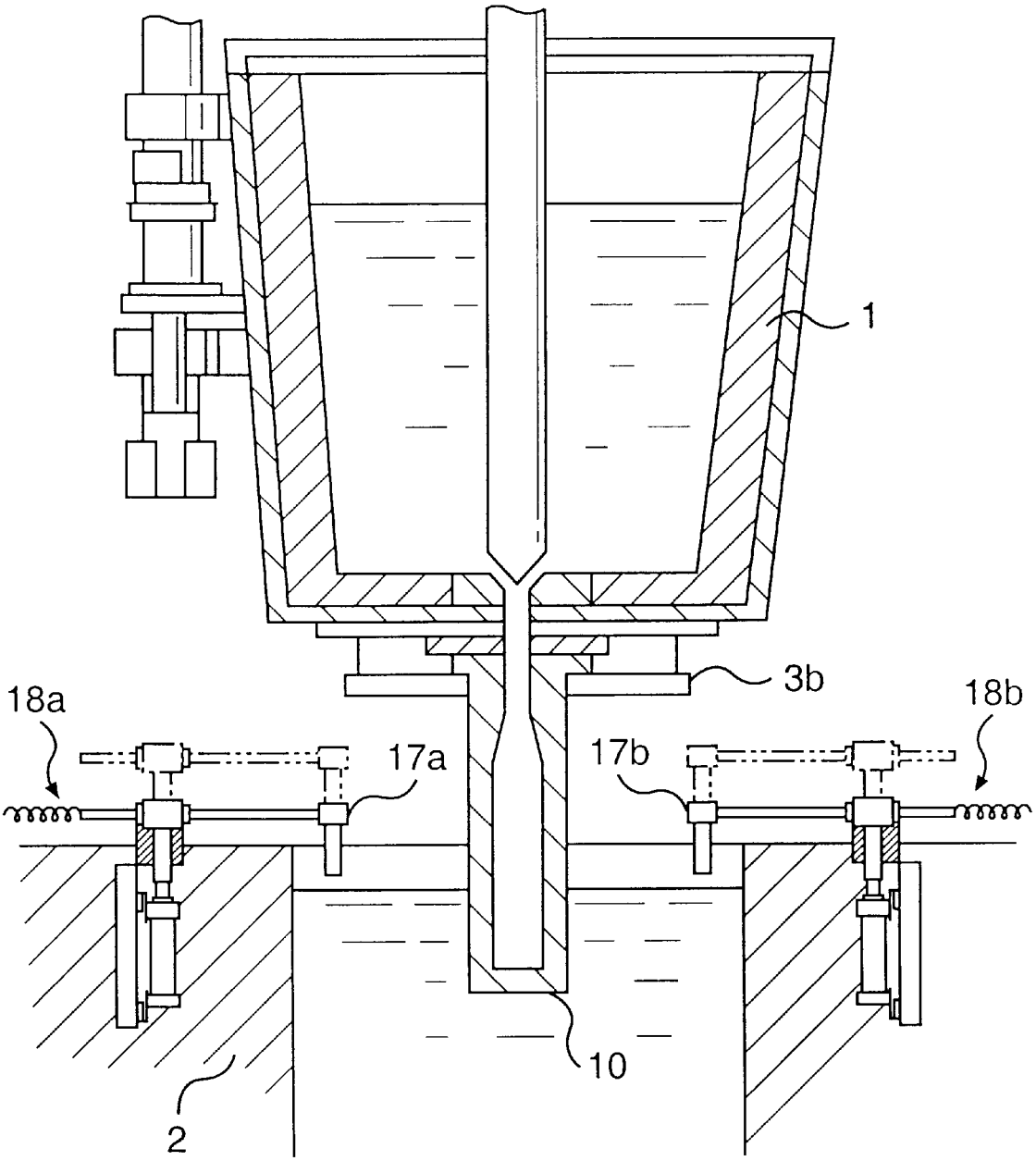
FIG. 13*a* is an enlarged schematic view of the level meters shown in FIG. 13.
Figure 14:
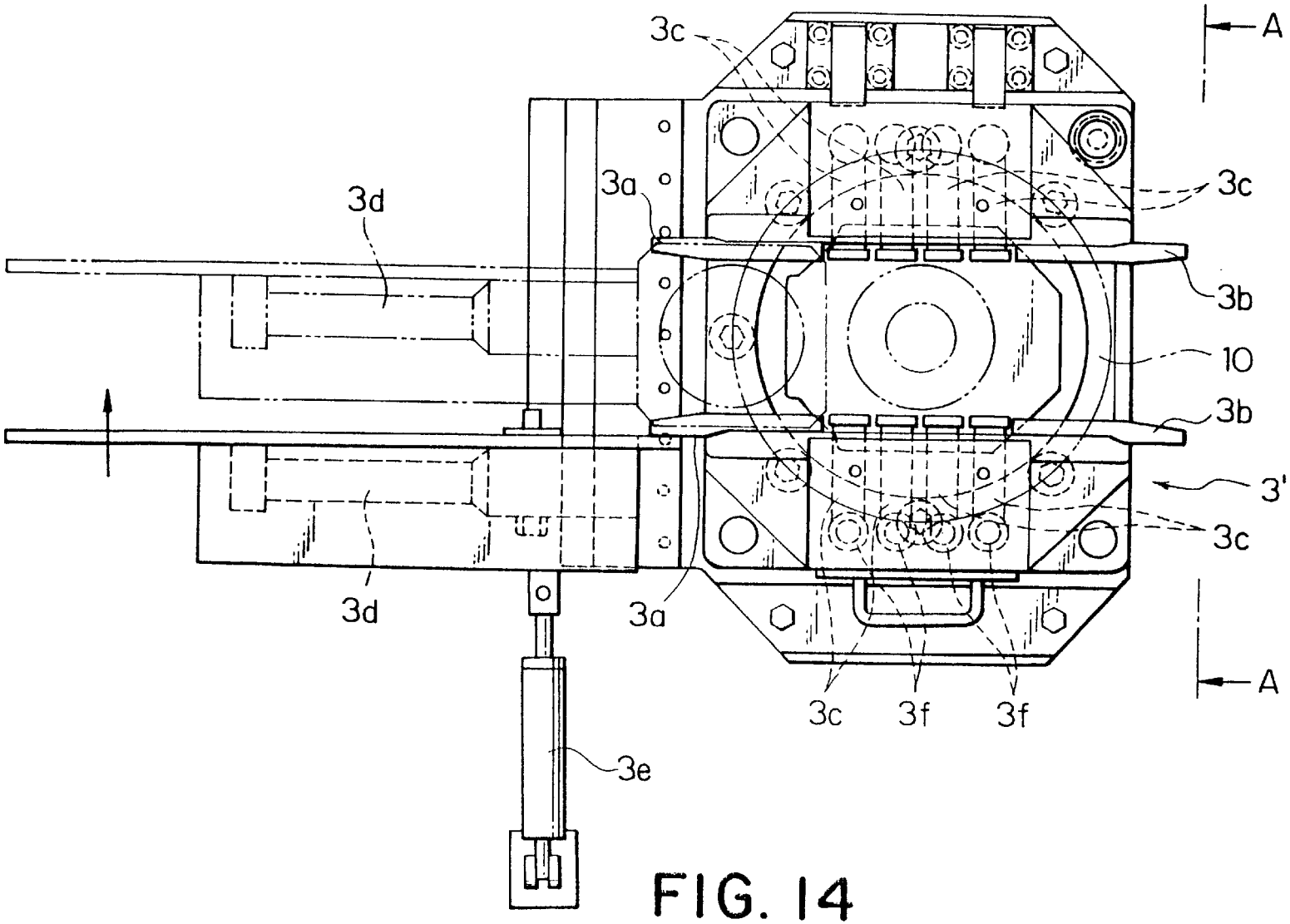
FIG. 14 is an enlarged view of a nozzle holding apparatus shown in FIG. 13 seen from a lower side.

In this embodiment, a pair of level meters 17*a* and 17*b* are disposed in the mold 2 in order to measure the upper surface of the molten steel in the mold 2, that is, the level, as shown in FIGS. 13 and 13*a*. The level meter 17*a* is disposed on the inlet side guides 3*a*. The level meter 17*b* is disposed on the outlet side guides 3*b*. In such a manner, a pair of level meters 17*a* and 17*b* are disposed for the following reason. When the dimension of the cavity 21 of the mold 2 is 150 mm or less in the thickness direction, during the insertion or takeout of the immersing nozzle, the level meter is the obstacle. Therefore, the two level meters 17*a* and 17*b* are installed and switched so as to thereby be used. By a withdrawing mechanism as described below, the level meters 17*a* and 17*b* are withdrawn to the position where they are not the obstacles to the insertion and takeout of the immersing nozzle. That is, when the new immersing nozzle is inserted, the level meter 17*a* is withdrawn by an inlet side withdrawing mechanism 18*a* to another position (shown in broken lines) and the level meter 17*b* is used. When the old immersing nozzle is taken out, the level meter 17*b* is withdrawn by an outlet side withdrawing mechanism 18*b* to another position (shown in the broken lines) and the level meter 17*a* is used.

Referring to FIG. 13, the following description is provided for the method of introducing the new immersing nozzle into the nozzle holding apparatus 3' and of taking out the old immersing nozzle from the nozzle holding apparatus 3' by the use of the nozzle replacing apparatus according to this embodiment.

The insertion of the new immersing nozzle into the nozzle holding apparatus 3' is accomplished in the following manner. The head plate 10-1 of the new immersing nozzle placed on the above-mentioned immersing nozzle preheater is gripped by the clamp mechanism 43. The handle 42 is rotated, whereby the new immersing nozzle is kept horizontal. Next, the roller 61 and the auxiliary roller 61*a* disposed on the tip end of the handling arm 4 are placed on the inlet side guide rail 62*a*. The handle 42 is then held so that the clamp mechanism 43 is horizontally moved to the inlet side guides 3*a* along the inlet side guide rail 62*a*. Meanwhile, the rotation of the handle 42 allows the new immersing nozzle to be counterclockwise rotated. At this time, since the lower portion of the new immersing nozzle is guided and rotated by the nozzle guide 7*a*, the deflection of the cavity 21 of the new immersing nozzle in the thickness direction (hereinafter, referred to as a transverse oscillation) is limited. Until the new immersing nozzle is vertically positioned, it is rotated. By the above operation, the insertion of the head plate 10-1 of the new immersing nozzle into the inlet side guides 3*a* is completed.

At the time of the insertion, the level meter 17*a* located on the inlet side guides 3*a* is withdrawn by the withdrawing mechanism 18*a* to the withdrawal position so that it may not be the obstacle to the insertion of the new immersing nozzle. Immediately after the insertion of the new immersing nozzle, there is also caused a powder splash fly including a molten powder with the rapid variation in the level. This is caused in the following manner. That is, when the new immersing nozzle is inserted, an unreacted powder enters from the outlet port of the new immersing nozzle into the nozzle, the flow of the molten steel dropping into the new immersing nozzle from the tundish 1 just after the insertion and the gas generated by a turbulent reaction due to the heat are blown out from the outlet port of the new immersing nozzle. This may not only have an adverse effect on the quality of a cast product but also stop the casting.

To account for the above respect, preferably, a protective cover is laminated to the outlet port 10-2 (see FIG. 12) of the new immersing nozzle by the use of a high-temperature adhesive after the preheating. As a material of the protective cover, a refractory cloth or the like, which has a higher melting point than the melting point of the powder and is melted by the contact with the molten steel, is preferable.

After the insertion of the new immersing nozzle, the handle 42 is held whereby the clamp mechanism 43 is horizontally moved and pulled out from the inlet side guides 3*a*. The withdrawing cylinder 3*e* is then actuated whereby the forcing cylinder 3*d* is moved to a forcing position as shown by a two-dot line in FIG. 14. The forcing cylinder 3*d* is actuated at this forcing position whereby the new immersing nozzle is forced into the arm 3*c* so as to thereby replace the immersing nozzle.

On the other hand, in order to control the level of the molten steel in the mold 2 before and after the replacement of the new immersing nozzle without once closing the opening of the stopper 12 and without reducing the casting velocity, the following conditions are considered.

Figure 18:
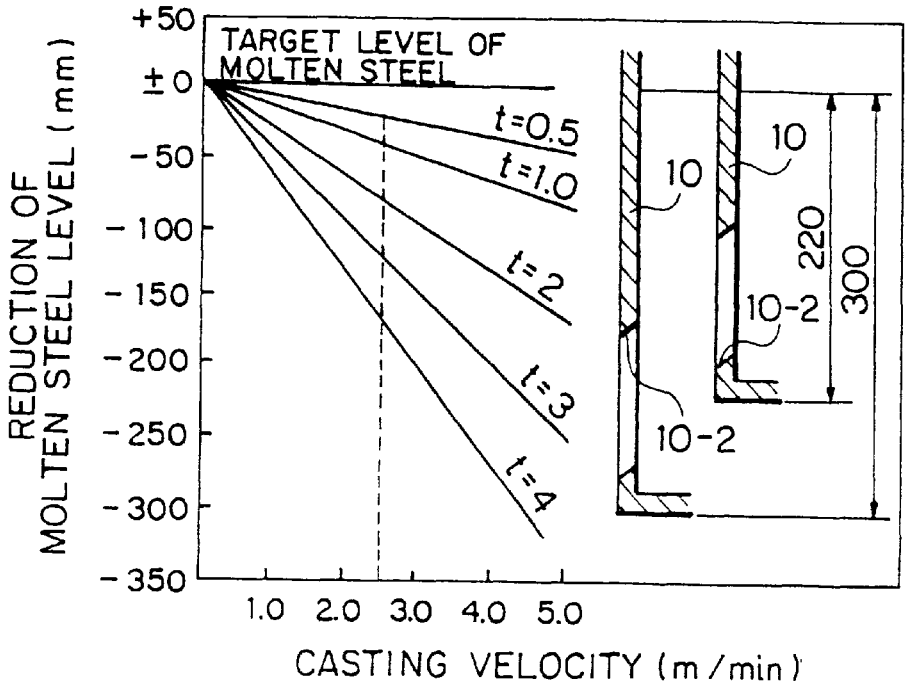
FIG. 18 is a characteristic graph showing the relationship between the casting velocity and a molten steel level reduction during a replacement of the immersing nozzle.

As shown in FIG. 18, from the relationship between the casting velocity and the reduction of the level of the molten steel in the mold 2 during the replacement of the new immersing nozzle, numerical data for satisfying the following conditions is determined by the experiment. A first conditions is that the reduction of the level of the molten steel is minimized during the replacement. A second condition is that the powder is not involved in the molten steel by the flow of the molten steel from the new immersing nozzle. A third condition is that the variation in the level is controlled at a speed of movement of the new immersing nozzle during the replacement of the new immersing nozzle.

In order to satisfy the above first through third conditions, it is better that the reduction of the level in the mold 2 is within 30 mm and a stopping time Ts of the molten steel during the replacing operation is within 1.0 sec. The stopping time Ts is represented by the following equation:

$$Ts=(Ln-2d)/Vn,$$

where Ln denotes the distance between the centers of the new immersing nozzle and the old immersing nozzle when the head plates 10-1 of the new immersing nozzle and the old immersing nozzle are in contact with each other, d denotes a diameter of a nozzle hole of the immersing nozzle and Vn denotes a forcing velocity.

In this case, it is seen from the experimental result that the forcing velocity of the forcing cylinder 3*d* may be within a range from 80 to 200 mm/sec.

Therefore, as soon as the forcing cylinder 3*d* is actuated, the open of the opening of the tundish 1 for controlling a flow rate is maintained for a predetermined time period by the stopper 12. After a predetermined time period, the control of the level of the molten steel just after the replacement is continued by the level meter 17*b* located on the outlet side guides 3*b* so as to thereby measure the level. When the replacement of the new immersing nozzle is completed, the level meter 17*a* located on the inlet side guides 3*a* is inserted into the mold 2. The level meter 17*a* takes over the control of the level of the molten steel from the level meter 17*b*.

The takeout of the old immersing nozzle from the nozzle holding apparatus 3' is accomplished by the following procedure. After the level meter 17*a* takes over the control of the level of the molten steel, the level meter 17*b* is withdrawn to the withdrawal position by the outlet side withdrawing mechanism 18*b*. At the same time when the new immersing nozzle is forced by an actuation of the forcing cylinder 3*d*, the head plate 10-1 of the old immersing nozzle pushed out to the outlet side guides 3*b* is gripped by the clamp mechanism 43. At this time, The roller 61 and the auxiliary roller 61*a* are placed on the outlet side guide rail 62*b*.

The handle 42 is then held, whereby the clamp mechanism 43 is horizontally moved along the outlet side guide rail 62*b* while the rotation of the handle 42 allows the old immersing nozzle to be counterclockwise rotated and to be thereby kept horizontal. At this time, since the lower portion of the old immersing nozzle is guided and rotated by the nozzle guide 7*b*, the transverse oscillation of the old immersing nozzle is limited. By the above operation, the takeout of the head plate 10-1 of the old immersing nozzle from the outlet side guides 3*b* is completed.

Next, the result of the experiment for confirming an effect of the present invention will be described. Table 1 shows casting conditions when the new immersing nozzle is inserted into the nozzle holding apparatus 3' and the old immersing nozzle is taken out from the nozzle holding apparatus 3' by the replacing method according to this embodiment.

TABLE 1

| Item | Case 1 | Case 2 |
|---|---|---|
| Mold thickness (upper): mm | 92 | 92 |
| (lower): mm | 91.5 | 91.5 |
| width (upper): mm | 1018 | 1524 |
| (lower): mm | 1008 | 1510 |
| Casting velocity: m/min | 2.5 | 4.0 |
| Immersing nozzle thickness: mm | 62 | 62 |
| width: mm | 150 | 150 |
| immersion depth: mm | 220 | 300 |
| downward discharging angle: | 45 | 45 |
| length of one side of head plate: mm | 220 | 220 |
| diameter of nozzle hole: mm | 75 | 75 |
| Control precision of molten steel level: mm | ±4≧ | ±4≧ |
| Type of cast steel | Medium-carbon steel | Low-carbon steel |

[Case 1]

The new immersing nozzle preheated up to 1100° C. by the immersing nozzle preheater during the casting is gripped and removed by the previously horizontally leveled clamp mechanism 43 so that a side surface of the head plate 10-1 and a body of the new immersing nozzle may be defined as reference surfaces. Immediately after the removal, the two outlet ports 10-2 of the new immersing nozzle are covered with the refractory cloth by means of the adhesive. The refractory cloth contains 52 w % of alumina and 46 w % of silica and has a melting point of 1260° C. The adhesive has a main component containing alumina and silica.

Next, the rotation of the handle 42 allows the new immersing nozzle to be kept horizontal. The roller 61 and the auxiliary roller 61*a* on the tip end of the handling arm 4 are placed on the inlet side guide rail 62*a*. The handle 42 is held whereby the new immersing nozzle is horizontally moved toward the mold 2 while the rotation of the handle 42 permits the new immersing nozzle to be rotated downward. During this rotation, the nozzle guide 7*a* guides the lower end of the new immersing nozzle. The head plate 10-1 is inserted into the inlet side guides 3*a* of the nozzle holding apparatus 3' without stopping the rotation. After the insertion, the clamp mechanism 43 alone is withdrawn.

After the withdrawal of the clamp mechanism 43, the withdrawing cylinder 3*e* is actuated whereby the forcing cylinder 3*d* is moved forward. The forcing cylinder 3*d* is actuated at a forward limit position whereby the new immersing nozzle inserted in the inlet side guides 3*a* is forced into the arm 3*c*. At this time, if the forcing velocity of the forcing cylinder 3*d* is too fast, this causes the variation in the level of the molten steel in the mold 2. Thus, the too fast forcing velocity is not desirable. Since the diameter of the outlet port 10-2 of the new immersing nozzle used in this case is 75 mm, the forcing velocity is set to about 150 to 200 mm/sec. The time Ts to stop the feed of the molten steel is also set to about 0.3 to 0.6 sec.

Figure 19:
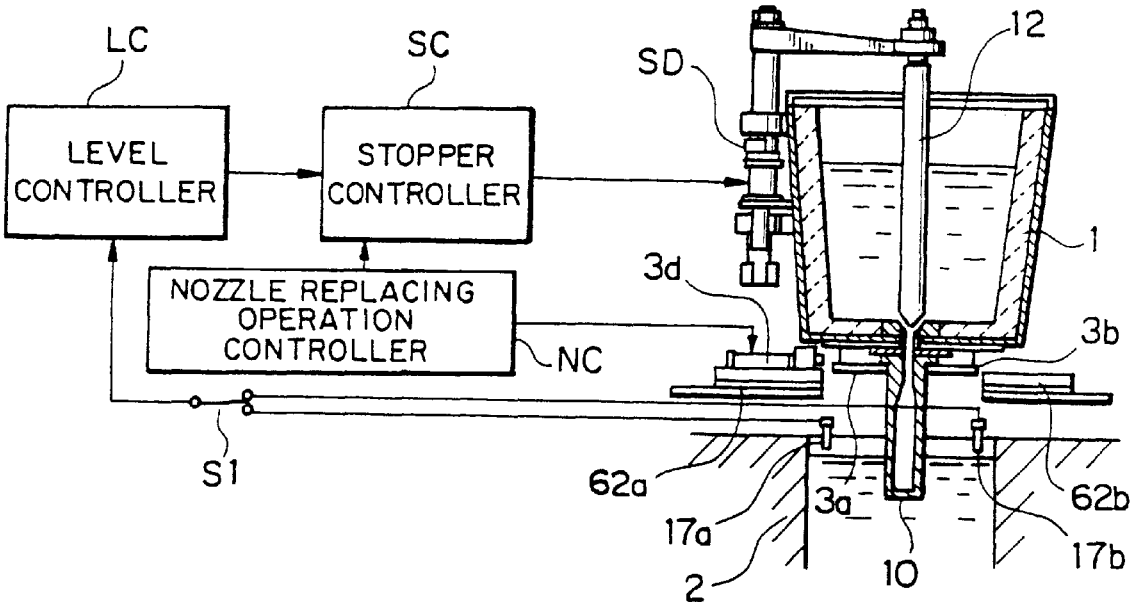
FIG. 19 is an illustration showing the arrangement of a switch controller of level meters.

FIG. 19 is an illustration of the arrangement of a switch controller of the level meter. FIG. 19 shows the arrangement of a control system of the slab continuous casting machine. This control system includes a switch S1 for switching signals from the level meters 17*a* and 17*b*, a level controller LC for controlling the level of the mold 2, a stopper controller SC for adjusting the open of the opening on the bottom portion of the tundish 1 by lifting/lowering the stopper 12 and an nozzle replacing operation controller NC. The nozzle replacing operation controller NC controls driving of the forcing cylinder 3*d* and the withdrawing cylinder 3*e* described above. The nozzle replacing operation controller NC also outputs the signal to the stopper controller SC so as to indicate whether a control operation is turned on or off. The tundish 1 is provided with a stopper driver SD.

In this case, the level meter 17*a* is connected to the level controller LC by the switch S1. The level meter 17*a* detects the level in the mold 2. The level meter 17*a* then outputs a level detection signal indicating the detected level. If the detected level is higher than a predetermined set value, the level controller LC outputs a stopper open instructing signal for lowering the stopper 12 to the stopper controller SC. The stopper controller SC controls the stopper driver SD so as to lower the stopper 12 in response to this stopper open instructing signal. If the detected level is lower than a predetermined set value, the level controller LC outputs the stopper open instructing signal for lifting the stopper 12 to the stopper controller SC. The stopper controller SC controls the stopper driver SD so as to lift the stopper 12 in response to this stopper open instructing signal.

During the replacing operation of the immersing nozzle 10, the nozzle replacing operation controller NC controls the driving of the forcing cylinder 3*d* and the withdrawing cylinder 3*e*. During the replacing operation of the immersing nozzle 10, the nozzle replacing operation controller NC also outputs the signal to the stopper controller SC so as to instruct that the control operation is turned off, whereby the control operation of the stopper controller SC is stopped for a short time. In other words, at the time of the replacing operation of the immersing nozzle 10, the opening of the tundish 1 is closed by the stopper 12, whereby the feed of the molten steel from the tundish 1 to the mold 2 is stopped for a short time. Even when the feed of the molten steel is stopped, the slab is being removed. However, since the time to stop the feed of the molten steel is short, the reduction of the level of the mold 2 has no problem.

When the replacing operation of the immersing nozzle 10 is completed, the nozzle replacing operation controller NC outputs the signal to the stopper controller SC so as to indicate the control operation is turned on. As a result, the level control of the mold 2 by the level controller LC is restarted.

In the above-described control system, this switch controller is used. At the same timing as an instruction to actuate the forcing cylinder 3*d*, the open of the stopper 12, which has previously controlled the level of the molten steel, is maintained for 0.5 sec. After an elapse of 0.5 sec, the control for the stopper 12 is restored. Immediately before and after the replacement of the new immersing nozzle, an example of the variation in the level of the molten steel is shown in FIG. 20.

Figure 20:
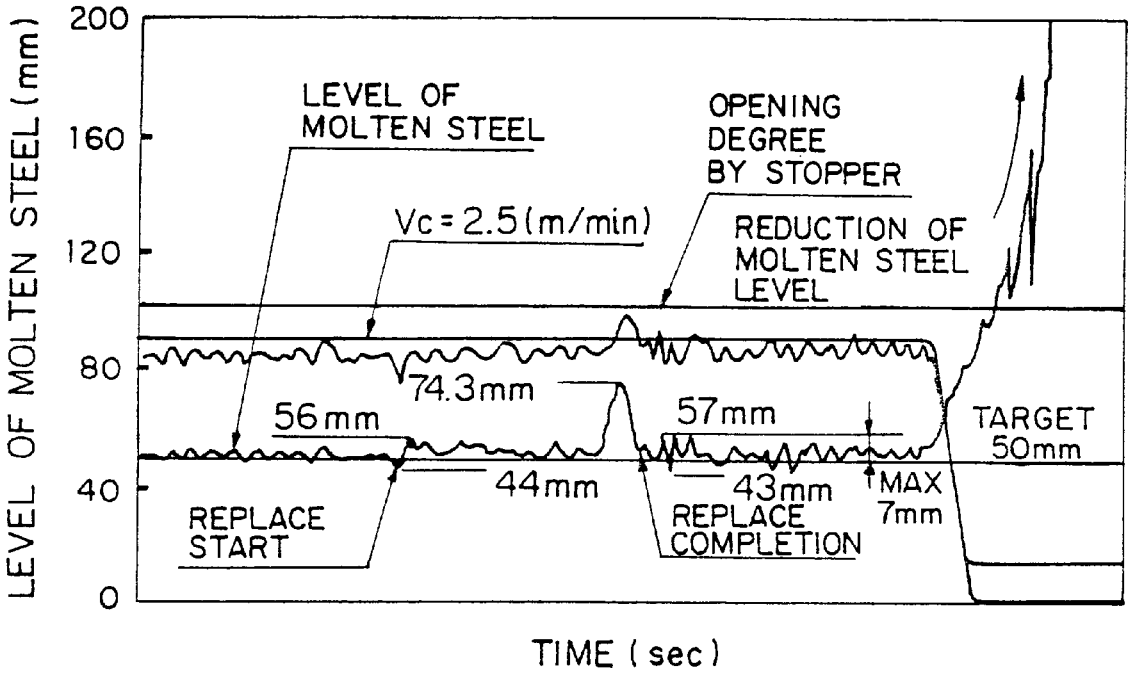
FIG. 20 is a characteristic graph for describing conditions of a variation in the level of the molten steel during the replacement of the immersing nozzle.

As can be seen from FIG. 20, when the new immersing nozzle is inserted into the nozzle holding apparatus 3' and replaced by the present invention, it should be understood that the variation in the level of the molten steel in the mold 2 is within 7 mm at maximum. Compared to the variation in the level of the molten steel in case that the refractory cloth is not laminated on the outlet port 10-2 of the new immersing nozzle, an improved effect in the order of 3 mm is observed. Needless to say, in case of the present invention, the powder splash fly does not occur.

When the present invention is implemented, as a method of maintaining the open of the opening of the tundish 1 by the stopper 12, the above-described method may be replaced by a method of allowing a controller to calculate an average velocity for the past several seconds to tens of seconds during the casting at a constant speed and of maintaining the open together with an open maintaining instruction. When this method is adopted, the level of the molten steel is further stabilized immediately after the replacement. An open maintaining time must be determined in consideration of a delay of a response of a hydraulic system and a mechanical system to the instruction and a delay of a level control system.

As described above, after the forcing of the new immersing nozzle, the level meter 17*a* is rapidly inserted into the mold 2. After a confirmation of a level detection output, the level meter 17*b*, which has so far detected the level, is withdrawn from the mold 2.

During the replacement of the new immersing nozzle and the operation to switch the level meters, the handling arm 4 is moved to the old immersing nozzle. The rotation of the handle 42 allows the arm body 41 to be rotated. The roller 61 and the auxiliary roller 61*a* are then placed on the outlet side guide rail 62*b*. The handling arm 4 is horizontally moved to the outlet side guides 3*b*. The old immersing nozzle is gripped by the clamp mechanism 43. After the old immersing nozzle is gripped, the handling arm 4 is horizontally moved to the outlet side guides 3*b*. The head plate 10-1 is removed from the outlet side guides 3*b*. The lower end of the old immersing nozzle is guided to the nozzle guide 7*b*. The handling arm 4 is then horizontally moved while the rotation of the handle 42 allows the old immersing nozzle to be kept horizontal and to be taken out.

If the replaced old immersing nozzle is placed in the mold 2 for a long time, the flow velocity of the molten steel is reduced. In addition, this causes a thin solidification of the level and the failure in melting of the powder, whereby this is the obstacle to the subsequent casting. Thus, it is desirable that the old immersing nozzle is taken out from the mold as fast as possible. In case of this embodiment, after the replacement, if the time required for the takeout of the old immersing nozzle from the mold 2 is within 42 seconds, it has no effect on the casting.

[Case 2]

In a case 2, the width of the cavity 21 of the mold 2 is wider. The case 2 can be implemented in the same manner as the case 1. However, since the casting velocity in the case 2 is faster than that in the case 1, as shown in FIG. 18, in order to prevent the reduction of the molten steel level from being greater, the forcing velocity of the forcing cylinder 3*d* is set to 0.3 sec faster than the forcing velocity in the case 1. Before and after the replacement, the variation in the level of the molten steel is such that the casting can be performed in the same manner as the case 1.

Depending on a molten steel discharging angle and the immersion depth H of the immersing nozzle, the powder excessively reducing the molten steel level is involved in a discharge flow, whereby the quality of the cast product is deteriorated. In this case, the casting velocity may be 70 to 80% reduced for an implementation. Furthermore, needless to say, when the immersing nozzle is replaced two or three times during the casting by the present invention, the level meter 17*a* is again switched to the level meter 17*b* prior to the replacement.

In this embodiment, although the control of the molten steel level in the mold is accomplished by the stopper 12, the control by the slide gate is, of course, applicable.

As described above, according to the second embodiment, more specifically, when the immersing nozzle is replaced during the continuous casting of the slab having a medium thickness, the new immersing nozzle can be inserted into the nozzle holding apparatus and the old immersing nozzle can be taken out from the nozzle holding apparatus without stopping the casting, without reducing the casting velocity and without once stopping the feed into the mold. Accordingly, the present invention is directed toward an improvement of productivity and is more effective for the reduction of a maintenance cost and a refractory cost of the tundish.

What is claimed is:

1. A slab continuous casting machine comprising:

a tundish for reserving a molten steel therein;

a nozzle holding means disposed on an outer bottom portion of said tundish;

a mold for use in a casting;

an immersing nozzle mounted in said nozzle holding means and for pouring the molten steel in said tundish into said mold; and a handling arm for gripping an upper portion of said immersing nozzle so as to thereby move said immersing nozzle;

said immersing nozzle extending from said nozzle holding means into a cavity of said mold, and said cavity having a generally rectangular sectional shape defined by a pair of short sides and a pair of long sides;

wherein said handling arm includes a roller disposed on its tip end;

a guide rail being disposed over said mold in order to guide said roller so that it may extend parallel to said long sides of said cavity;

said guide rail including:

an inlet side guide rail disposed near one side of said pair of short sides of said mold in order to guide said roller when said immersing nozzle gripped by said handling arm is attached into said nozzle holding means; and an outlet side guide rail disposed near the other side of said pair of short sides of said mold in order to guide said roller when said immersing nozzle is removed from said nozzle holding means by said handling arm;

when said immersing nozzle is inserted into said mold and when said immersing nozzle is taken out from said mold, a movement of said immersing nozzle gripped by said handling arm in said mold being limited in a direction parallel to said pair of short sides.

2. A slab continuous casting machine as claimed in claim 1, wherein said handling arm further includes:

a rotatable arm body supported by a freely movable support bracket;

a handle for rotating said arm body; and a clamp mechanism disposed in said arm body and for gripping the upper portion of said immersing nozzle;

said roller being disposed on the tip end of said arm body.

3. A slab continuous casting machine as claimed in claim 2, wherein said handling arm further includes an auxiliary arm mounted on said support bracket and extending parallel to said arm body; and an auxiliary roller mounted on the tip end of said auxiliary arm and guided by said inlet side guide rail and said outlet side guide rail.

4. A slab continuous casting machine as claimed in claim 3, wherein a nozzle guide is disposed over said mold, said nozzle guide being for limiting the movement of a lower portion of said immersing nozzle in said mold in the direction parallel to said pair of short sides when said immersing nozzle is inserted into said mold and when said immersing nozzle is taken out from said mold.

5. A slab continuous casting machine as claimed in claim 4, wherein said nozzle guide includes a pair of guide rollers for guiding said immersing nozzle at both sides thereof.

6. A slab continuous casting machine as claimed in claim 5, wherein, during an insertion of said immersing nozzle into said mold, said immersing nozzle is rotated about the support of said upper portion by said arm body while it is inserted into said mold;

said nozzle guide further including an auxiliary guide roller for guiding said insertion of said immersing nozzle.

7. A slab continuous casting machine as claimed in claim 6, wherein said inlet side guide rail and said outlet side guide rail are disposed on the outer bottom portion of said tundish.

8. A slab continuous casting machine as claimed in claim 7, wherein said mold includes, near one side of said pair of short sides, an inlet side level meter for measuring a level of the molten steel in said mold; and an inlet side withdrawing mechanism for withdrawing said inlet side level meter to a position apart from said cavity;

said mold further including, near the other side of said pair of short sides, an outlet side level meter for measuring the level of the molten steel in said mold; and an outlet side withdrawing mechanism for withdrawing said outlet side level meter to the position apart from said cavity.

9. A slab continuous casting machine as claimed in claim 6, wherein said inlet side guide rail and said outlet side guide rail are disposed in said nozzle holding means.

10. A method of replacing an immersing nozzle in a slab continuous casting machine which comprises a tundish for reserving a molten steel therein; a nozzle holding means disposed on an outer bottom portion of said tundish; a mold for use in a casting; an immersing nozzle mounted in said nozzle holding means and for pouring the molten steel in said tundish into said mold; and a handling arm for gripping an upper portion of said immersing nozzle so as to thereby move said immersing nozzle, said immersing nozzle extending from said nozzle holding means into a cavity of said mold, and said cavity having a generally rectangular sectional view defined by a pair of short sides and a pair of long sides;

wherein said handling arm includes a roller disposed on its tip end;

a guide rail being disposed over said mold in order to guide said roller so that it may extend parallel to said long sides of said cavity;

said guide rail including:

an inlet side guide rail disposed near one side of said pair of short sides of said mold in order to guide said roller when said immersing nozzle gripped by said handling arm is inserted into said mold; and an outlet side guide rail disposed near the other side of said pair of short sides of said mold in order to guide said roller when said immersing nozzle is taken out from said mold by said handling arm;

said method comprising the steps of:

when a new immersing nozzle is attached into said nozzle holding means, gripping said new immersing nozzle by said handling arm so as to thereby keep said new immersing nozzle horizontal;

placing said roller on said inlet side guide rail;

carrying, over said mold, said new immersing nozzle which is kept horizontal by guiding said roller by said inlet side guide rail and horizontally moving said handling arm gripping said new immersing nozzle; and rotating said new immersing nozzle about a support of said upper portion so as to thereby insert said new immersing nozzle into said mold;

whereby the movement of said new immersing nozzle gripped by said handling arm in said mold is limited in the direction parallel to said pair of short sides by said inlet side guide rail; and said method further comprising the steps of:

when said immersing nozzle is removed from said nozzle holding means, placing said roller of said handling arm on said outlet side guide rail;

gripping said immersing nozzle by said handling arm, rotating said immersing nozzle about the support of said upper portion and thus keeping said immersing nozzle horizontal so as to thereby take out said immersing nozzle from said mold; and guiding said roller by said outlet side guide rail while horizontally moving said handling arm so as to thereby carry out said immersing nozzle to a position apart from said mold;

whereby the movement of said immersing nozzle gripped by said handling arm in said mold is limited in the direction parallel to said pair of short sides by said outlet side guide rail.

11. An immersing nozzle replacing method as claimed in claim 10, wherein a nozzle guide for guiding said immersing nozzle is disposed over said mold, said nozzle guide limiting the movement of the lower portion of said immersing nozzle in said mold in the direction parallel to said pair of short sides when said new immersing nozzle is inserted into said mold and when said immersing nozzle is taken out from said mold.

12. An immersing nozzle replacing method as claimed in claim 11, wherein said cavity of said mold includes, near one side of said pair of short sides, an inlet side level meter for measuring the level of the molten steel in said mold; and an inlet side withdrawing mechanism for withdrawing said inlet side level meter to the position apart from said cavity;

said cavity of said mold further including, near the other side of said pair of short sides, an outlet side level meter for measuring the level of the molten steel in said mold;

and an outlet side withdrawing mechanism for withdrawing said outlet side level meter to the position apart from said cavity;

when said new immersing nozzle is inserted into said mold, a withdrawal of said inlet side level meter allowing said outlet side level meter to measure the level of the molten steel in said mold while the insertion is performed; and when said immersing nozzle is taken out from said mold, the withdrawal of said outlet side level meter allowing said inlet side level meter to measure the level of the molten steel in said mold while a takeout is performed.

13. An immersing nozzle replacing method as claimed in claim 12, wherein, when said new immersing nozzle is inserted into said mold, a protective cover for preventing an invasion of a powder during the casting is disposed on an outlet port of said new immersing nozzle.

* * * * *